US006571698B1

(12) United States Patent
Kagawa

(10) Patent No.: US 6,571,698 B1
(45) Date of Patent: Jun. 3, 2003

(54) MASTER MAKING AND FEEDING DEVICE FOR A PRINTER

(75) Inventor: Hideyuki Kagawa, Miyagi (JP)

(73) Assignee: Tohoku Ricoh Co., Ltd., Shibata-gun (JP)

( * ) Notice: Subject to any disclaimer, the term of this patent is extended or adjusted under 35 U.S.C. 154(b) by 0 days.

(21) Appl. No.: 09/662,349

(22) Filed: Sep. 14, 2000

(30) Foreign Application Priority Data

Nov. 30, 1999 (JP) ..... 11-339986

(51) Int. Cl.[7] ..... B41C 1/14
(52) U.S. Cl. ..... 101/128.4; 101/116
(58) Field of Search ..... 101/114, 116, 101/128.21, 128.4, 129

(56) References Cited

U.S. PATENT DOCUMENTS

| | | | | |
|---|---|---|---|---|
| 5,740,731 A | | 4/1998 | Kagawa | |
| 5,782,179 A | | 7/1998 | Kagawa et al. | |
| 5,816,149 A | | 10/1998 | Kagawa et al. | |
| 5,893,324 A | * | 4/1999 | Kimura | 101/117 |
| 5,970,869 A | | 10/1999 | Hara et al. | |
| 5,988,061 A | | 11/1999 | Kagawa | |
| 6,076,460 A | | 6/2000 | Kagawa | |

FOREIGN PATENT DOCUMENTS

| | | |
|---|---|---|
| JP | 61-287781 | 12/1986 |
| JP | 2-274 | 1/1990 |
| JP | 4-189544 | 7/1992 |
| JP | 5-201115 | 8/1993 |
| JP | 6-247031 | 9/1994 |
| JP | 7-17013 | 1/1995 |
| JP | 7-97813 | 10/1995 |
| JP | 9-216448 | 8/1997 |
| JP | 9-226088 | 9/1997 |
| JP | 10-157052 | 6/1998 |
| JP | 10-181177 | 7/1998 |
| JP | 10-202996 | 8/1998 |
| JP | 11-20295 | 1/1999 |
| JP | 11-91227 | 4/1999 |

* cited by examiner

*Primary Examiner*—Ren Yan
(74) *Attorney, Agent, or Firm*—Oblon, Spivak, McClelland, Maier & Neustadt, P.C.

(57) ABSTRACT

A master making and feeding device for a printer includes a first conveying section and a second conveying section. When the first conveying section is perforating a stencil or after it has perforated a stencil, conveyance drive means drives the second conveying section at a preselected timing in order to feed the leading edge of the stencil to a print drum. At this instant, the conveyance drive means drives the second conveying section such that it conveys the stencil at a higher speed than the first conveying section. The device is capable of reducing a period of time necessary for the leading edge of the perforated stencil to be fed to the print drum and therefore a first print time.

16 Claims, 22 Drawing Sheets

SAME AS FIG.5 HEREAFTER

MASTER MAKING AND FEEDING DEVICE FOR A PRINTER

BACKGROUND OF THE INVENTION

The present invention relates to a master making and feeding device for a printer and more particularly to a master making and feeding device capable of perforating a stencil with heat and feeding the perforated stencil or master to a print drum.

A thermal digital printer using a stencil (stencil printer hereinafter) is extensively used as a simple printer. A stencil printer includes a thermal head having a plurality of fine heat generating elements arranged thereon in the main scanning direction. The head is brought into contact with a thermosensitive stencil, which includes a thermoplastic resin film, via a platen roller. While the stencil is conveyed, the heat generating elements are selectively energized to perforate the stencil with heat in accordance with image data, thereby making a master. After the master has been wrapped around a porous print drum, ink is fed to the drum from the inside of the drum. A press roller, press drum or similar pressing means presses a paper sheet against the print drum via the master. As a result, the ink oozes out via the print drum and the perforations of the master to thereby print an image on the paper sheet.

A master making and feeding device feeds the perforated stencil to the print drum. It is a common practice with a master making and feeding device to use a single stepping motor or drive means for driving a platen roller, a stencil set roller, a tension roller pair, and a turn roller pair, as taught in, e.g., Japanese Patent Laid-Open Publication Nos. 9-226088, 10-181177 and 11-91227. The stencil set roller corresponds to a pay-out roller 40 shown in FIGS. 2 and 3 of Laid-Open Publication No. 9-226088 mentioned above. The tension roller pair corresponds to a first conveyor roller pair 72 taught in Laid-Open Publication No. 11-91227. Further, the turn roller pair corresponds to an upper and a lower turn roller 7 and 8 taught in Laid-Open Publication No. 9-226088 or to a second conveyor roller pair 74 taught in Laid-Open Publication No. 11-91227. The turn roller pair plays the role of conveying members for feeding the leading edge of the perforated stencil to the print drum. Drive transmission from the stepping motor to the turn roller pair is selectively set up or interrupted by a solenoid-operated clutch at a timing different from a timing assigned to the platen roller. This kind of master making and feeding device, however, has various problems left unsolved, as will be described in detail later.

Technologies relating to the present invention are also disclosed in, e.g., Japanese Patent Publication No. 7-97813, Japanese Patent Laid-Open Publication Nos. 4-189544, 10-157052, 10-202996, 6-247031, 9-216448 and 5-201115, Japanese Utility Model Publication No. 2-274, Japanese Patent Laid-Open Publication Nos. 11-20295, 7-17013 and 61-287781, U.S. Pat. Nos. 5,816,149, 5,740,731, 5,782,179 and 5,970,869, and U.S. Ser. Nos. 08/926,423 and 09/014,269.

SUMMARY OF THE INVENTION

It is therefore an object of the present invention to provide a master making and feeding device for a printer capable of capable of producing a print faithfully representative of a document image, and reducing a first print time (FPT) while allowing a stencil to be conveyed by a platen roller in a constant amount.

A master making and feeding device for a printer of the present invention includes a first conveying section including a rotatable platen roller for pressing a stencil between a master making device and the platen roller to thereby thermally perforate the stencil, and conveying the perforated stencil to the downstream side in the direction of stencil conveyance. A second conveying section is arranged between the first conveying section and a print drum, around which the perforated stencil is to be wrapped around, for conveying the perforated stencil conveyed by the first conveying section toward the print drum. A conveyance drive section drives, at a preselected timing during or after the perforation of the stencil effected by the first conveying section, the second conveying section to thereby feed the leading edge of the perforated stencil to the print drum. The conveyance drive section drives the second conveying section such that the second conveying section conveys the perforated stencil at a higher speed than the first conveying section.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
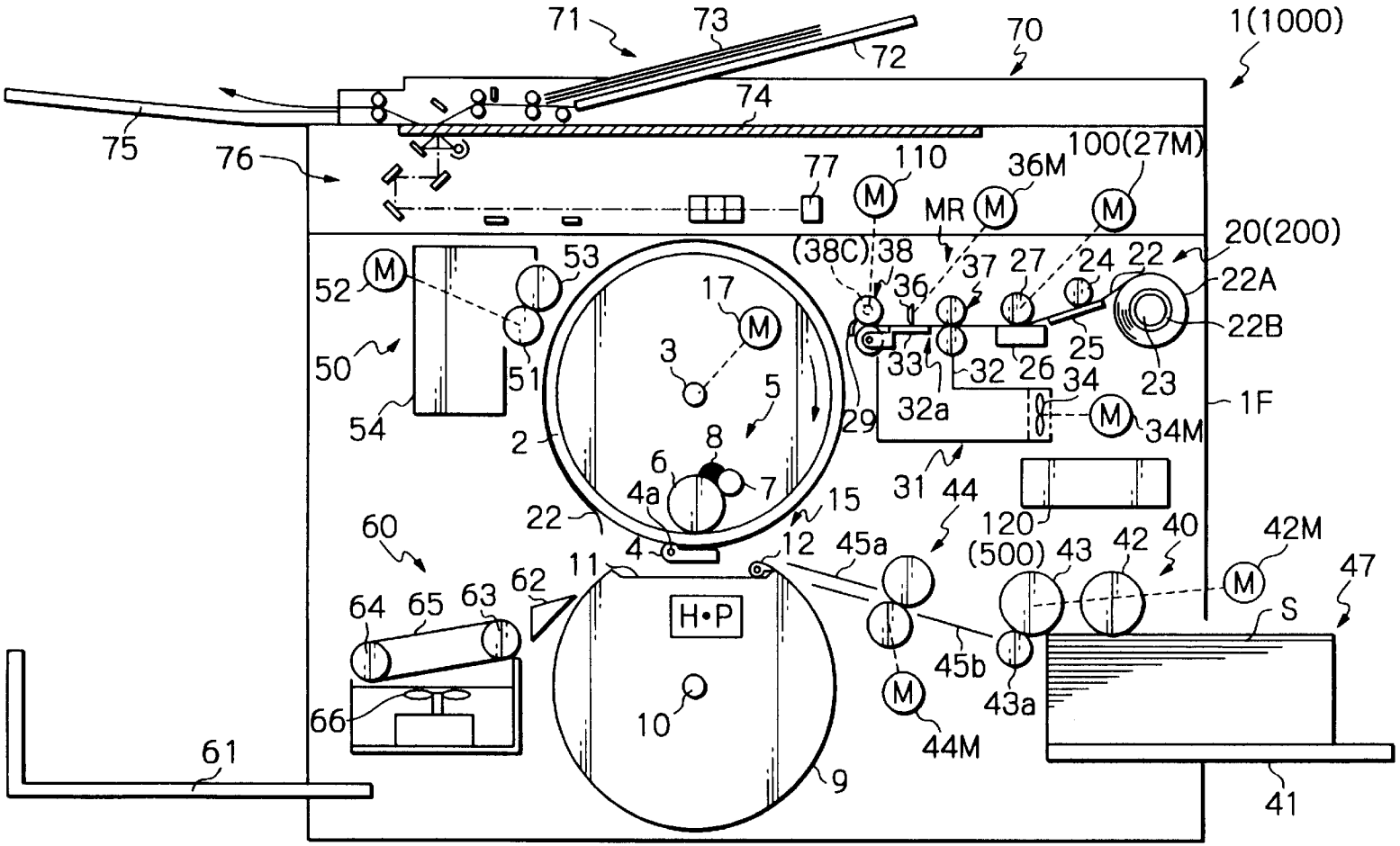
FIG. 1 is a front view showing the general construction of a stencil printer to which an embodiment of a master making and feeding device in accordance with the present invention is applied.

To better understand the present invention, reference will be made to a conventional stencil printer, shown in FIGS. 1, 3 and 10 through 21. As shown in FIG. 1, the stencil printer, generally designated by the parenthesized reference numeral 1,000, includes a main control unit designated by the parenthesized reference numeral 500, a master making and feeding section or device designated by the parenthesized reference numeral 200 and mounted on the printer 1,000, and a body frame 1F. The printer 1,000 is similar to the construction disclosed in previously mentioned Laid-Open Publication No. 10-181177 except that it additionally includes, e.g., the configuration shown in FIGS. 2 and 3 of Laid-Open Publication No. 9-226088 and the configuration shown in FIG. 1 of Laid-Open Publication No. 11-91227. Briefly, the printer 1,000 executes a high-speed mode 1 taught in Laid-Open Publication No. 10-181177 in order to reduce the amount of rotation of a print drum 2 to two rotations. In addition, the printer 1,000 reduces FPT, i.e., an interval between the operation of a start key and the discharge of the first print.

A document reading section 70 includes a glass platen 74, an ADF (Automatic Document Feeder) 71, and a scanner 76. The glass platen 74 is positioned in the upper portion of the body frame 1F such that a document may be laid on the glass platen 74. The ADF 71 sequentially conveys a document or documents 73 stacked on a tray 72 thereof to a preselected position of the scanner 76, which will be described specifically later. The scanner 76 is arranged below the ADF 71 and glass platen 74 for reading the document 73 fed from the ADF 71. A stencil roll 22A is positioned in one side portion of the body frame 1F below the document reading section 70. The master making and feeding section 200 perforates, or cuts, a stencil 22 paid out from the roll 22A to thereby make a master. A printing section 15 includes the previously mentioned print drum 2 and a press drum 9 positioned below the print drum 2. The press drum 9 has a damper or clamping means 12 thereon and presses a paper sheet S against the master, also labeled 22, wrapped around the print drum 2. The damper 12 clamps the leading edge of the paper sheet S.

A paper feeding section 40 is located below the master making and feeding section 200 for sequentially feeding paper sheets S stacked on a tray 41 one by one. A paper discharging section 60 is arranged in the lower portion of the body frame 1F in such a manner as to face the paper feeding section 40. The paper discharging section 60 conveys the paper sheet or print S coming out of the printing section 15 to a tray 61. A master discharging section 50 is interposed between the paper discharging section 60 and the document reading section 70 in order to peel off a used master 22 wrapped around the print drum 2 and discard it into a box 54. The main control unit 500 is positioned between the master making and feeding section 200 and the paper feeding section 40 and causes the printer 1,000 to perform various operations that will be described with reference to FIGS. 13 through 21 and 12 later.

More specifically, the ADF 71 includes a tray 75 for receiving the documents 73 in addition to the tray 72 for feeding the documents 73. The ADF 71 is bodily movable, or openable, away from the glass platen 74. The ADF 71 has a configuration shown in, e.g., FIG. 1 of Patent Publication No. 7-97813 mentioned earlier. The scanner 76 has conventional scanning optics including a lens, an image sensor 77, and a scanner motor not shown. When light reflected from the document 73 is incident to the image sensor 77 via the lens, the image sensor 77 transforms it to a corresponding electric signal. The electric signal is sent to a master making controller 19 (see FIG. 11) via an ADC (Analog-to-Digital Converter) section, not shown, disposed in the body frame 1F. The master making controller 19 is electrically connected to the main control unit 500 also shown in FIG. 11.

Figure 2:
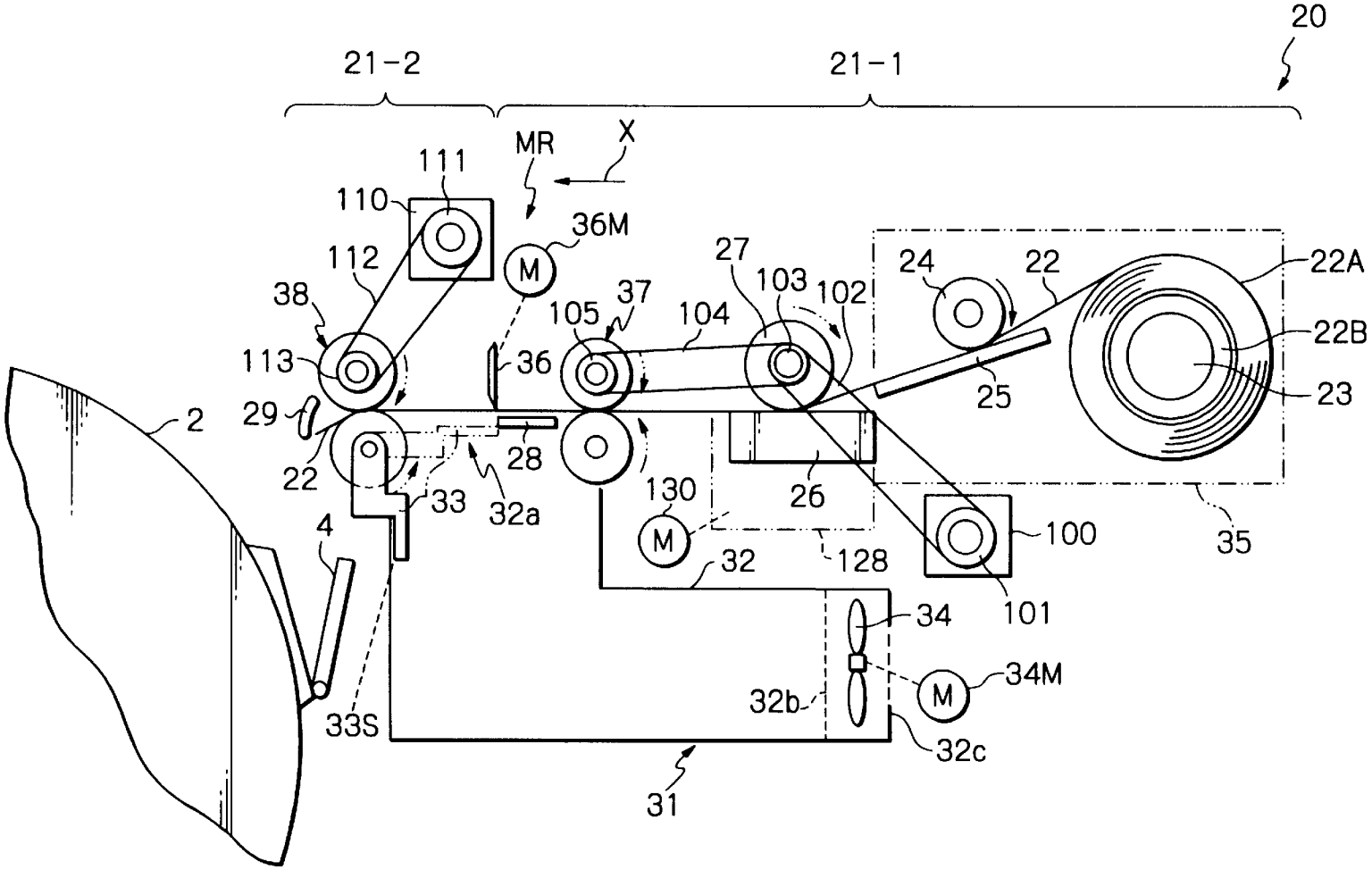
FIG. 2 is a fragmentary enlarged front view of a master making and feeding section included in the stencil printer.

The scanner 76 may have a configuration shown in, e.g., FIG. 2 of Laid-Open Publication No. 4-189544 mentioned earlier. The scanner 76 is capable of reading even a document laid on the glass platen 74 by hand without using the ADF 71 only if the scanner motor is driven.

Figure 11:
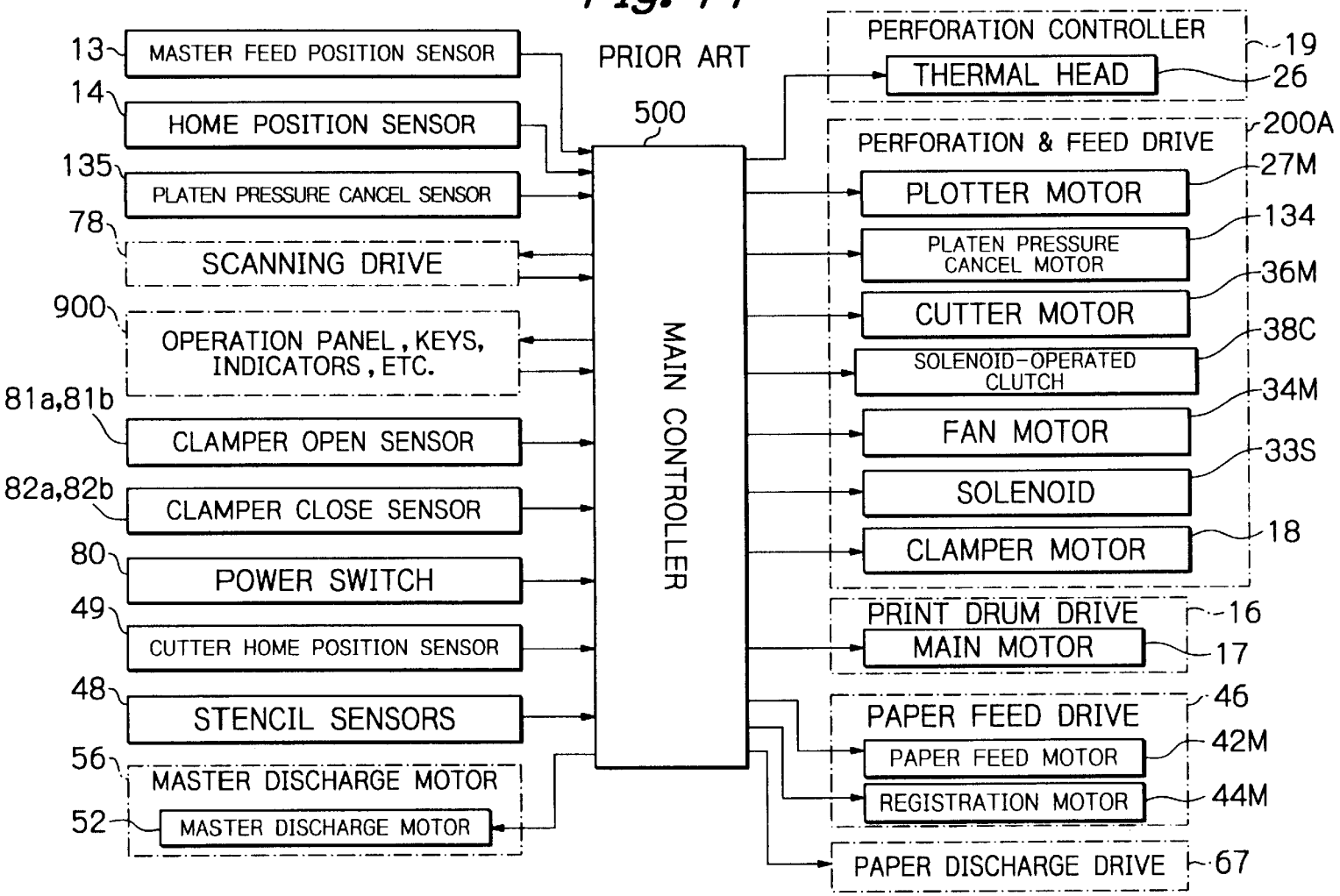
Fig. 11 PRIOR ART
FIG. 11 is a block diagram schematically showing a control system included in a conventional stencil printer.

Drive motors and other drive means, not shown, assigned to the ADF 71 for driving rollers and the scanner motor and other drive means, not shown, assigned to the scanner 76 for driving the optics are collectively represented by a scanning drive 78 in FIG. 11.

As shown in FIG. 1 in detail, the master making and feeding section 200 includes a roll support member or stencil storing means 23 that stores the stencil roll 22A such that the stencil 22 can be paid out from the roll 22A. Guide means, not shown, allows a roll holding unit 35 to move between a stencil feeding position defined in the body frame 1F (position shown in FIG. 10) and a stencil loading/unloading position, not shown, where the stencil roll 22A may be loaded or unloaded. A thermal head or perforating means 26 is positioned on a master conveyance path MR (simply path MR hereinafter) downstream of the master support member 23 in the direction in which the stencil 22 is conveyed. The thermal head 26 selectively perforates the stencil 22 being paid out from the roll 22A with heat in accordance with an image signal. A platen roller 27 rotates to convey the stencil 22 while pressing it against the head 26. A platen pressure canceling mechanism or moving means 128 selectively brings the head 26 into or out of contact with the platen roller 27. An upper and a lower tension roller 37 are provided in a pair on the path MR downstream of the platen roller 27 in the direction of stencil conveyance. A cutter 36 is located on the path MR downstream of the tension roller pair 37 in the direction of stencil conveyance for cutting the perforated or non-perforated stencil 22. A first guide plate 28 is positioned on the path MR between the tension roller pair 37 and the cutter 36. An upper and a lower turn roller 38 are provided in a pair on the path downstream of the cutter 36 in the direction of stencil conveyance. Master stocking means 31 is positioned on the path MR between the tension roller pair 37 and the turn roller pair 38 and includes a box 32 and a guide/conveyor plate 33. A second guide plate 29 is positioned on the path MR downstream of the turn roller pair 38 in the direction of stencil conveyance. A damper 4, which will be described later, is mounted on the print drum 2. The damper 4 and a damper motor 18 (see FIG. 11) constitute an opening/closing device.

The stencil roll 22A has at its center a tubular core 22B whose width is identical with the width of the stencil 22. Opposite ends of the stencil roll 22A and those of the core 22B are flush with each other. The stencil 22 implemented as a webbing is wound round the core 22B, forming the stencil roll 22A. 500 to 300 masters, for example, can be produced from a single stencil roll 22A. The stencil 22 is implemented by a laminate made up of a resin film as thin as 1 $\mu$m to 2 $\mu$m and a porous support adhered to the resin film. The resin film is formed of polyester or similar thermoplastic resin. The porous support is constituted by fibers of Japanese paper or synthetic fibers or a mixture thereof. The head 26 is capable of perforating the stencil 22 with heating generating elements thereof.

The roll support member 23 is affixed to the roll holding unit 35 such that the opposite ends of the core 22B can be removably and rotatably mounted to the member 23. The master holding unit 35 has a configuration shown in FIGS. 1 through 6 of Laid-Open Publication No. 9-226088 mentioned earlier. Specifically, the unit 35 includes the roll support member 23, a guide 25, and a stencil set roller or stencil conveying means 24. The roll support member 23 corresponds to roll flanges 25*a* and 25*b* shown in FIGS. 1 through 5 of the above document. The leading edge of the stencil 22 paid out from the roll 22A is positioned on the guide 25. The stencil set roller 24 contacts the guide 25 via the leading edge of the stencil 22 for conveying it. The stencil set roller 24 corresponds to a pay-out roller 40 shown in FIGS. 1 through 4 and 6 of the above document. Roll positioning and guiding means 30 and guide rails or guide means 79 shown in FIGS. 1 through 6 of the same document are arranged around the master holding unit 35. Also arranged around the master holding unit 35 are a plotter motor 27M and drive transmitting means operatively connected to the plotter motor 27M. The plotter motor 27M is used to convey the stencil 22 and to selectively rotate the stencil set roller 24. The drive transmitting means is implemented as, e.g., a plurality of gears shown in FIG. 6 of the above document.

The heat generating elements of the thermal head 26 are arranged in an array extending in the axial direction of the platen roller 27. Current is selectively fed to the heat generating elements in accordance with a digital image signal representative of a document image and output via the ADC section of the document reading section 70 and a perforation controller 19. As a result, the heat generating elements selectively generate heat to thereby melt and perforate corresponding portions of the stencil 22. The platen pressure canceling mechanism 128 selectively moves the head 26 into or out of contact with the platen roller 27, as stated earlier.

The platen pressure canceling mechanism 128 may have the same configuration as moving means 28 shown in FIGS. 1 through 7 of Laid-Open Publication No. 10-157052 mentioned earlier. A platen pressure cancel motor 134, which will be described with reference to FIGS. 11 and 12 later, corresponds in configuration and operation to a pressure cancel motor 34 shown in FIG. 5 of the above document. A platen pressure cancel sensor 135, which will also be described with reference to FIGS. 11 and 12 later, corresponds in configuration and operation to a contact sensor 35 shown in FIG. 5 of the same document.

The operation of the platen pressure canceling mechanism 128 and that of the platen pressure cancel sensor 135 are described in paragraphs (0044) through (0046) of the specification of Laid-Open Publication No. 10-157052. When the platen pressure cancel motor 134 is rotated by a preselected amount to a pressure canceling position, a platen pressure exerted by the head 26 on the platen roller 27 is cancel led (OFF) by way of a procedure that is described in the above document specifically. At this time, the platen pressure cancel sensor 135 turns off and starts outputting a release signal. When a power switch, not shown, is turned on, the motor 134 and sensor 135 each are brought to a particular home position, canceling the platen pressure.

When the platen pressure cancel motor 134 is rotated by a preselected amount to a pressing position, the head 26 contacts the platen roller 27 by way of a procedure that is also described in the specification of Laid-Open Publication No. 10-157052, exerting a preselected platen pressure (ON). At this time, the platen pressure cancel sensor 135 turns on and stops outputting the release signal.

The platen roller 27 is rotatably supported by opposite side walls of the master making and feeding section 200 via a shaft thereof. The plotter motor 27M (platen motor 27M taught in Laid-Open Publication No. 10-181177) drives the platen roller 27 via a pulley mounted on the above shaft, a drive pulley mounted on the output shaft of the plotter motor 27M and a timing belt passed over the two pulleys, although not shown specifically. The platen roller 27 conveys the stencil 22 to the downstream side in the direction of stencil conveyance, labeled X, while pressing it against the head 26. The plotter motor 27M is implemented by a stepping motor.

The tension roller pair 37 corresponds to a first conveyor roller pair 37 taught in Laid-Open Publication No. 10-181177. The upper and lower tension rollers 37 are a drive roller and a driven roller, respectively. The drive roller 37 is connected to the plotter motor 27M via pulleys and an endless belt or similar drive transmitting means not shown. The driven roller 37 is included in the platen pressure canceling mechanism 128 and movable into and out of contact with the drive roller 37.

The cutter 36 is connected to a cutter motor 36M by a wire and wire pulleys and implemented by a conventional rotary edge. The cutter motor 36M causes the cutter 36 to run in the widthwise direction of the stencil 22 while rotating about its own axis. The downstream end of the first guide plate 28 in the direction of stencil conveyance X plays the role of a stationary edge cooperative with the cutter or rotary edge 36. When the cutter 36 is not driven, it is held at a home position defined at one side of the path MR so as not to obstruct the conveyance of the stencil 22. On the path MR, the cutter 36 and first guide plate 28 are slightly shifted to the downstream side from corresponding positions shown in, e.g., FIG. 1 of Laid-Open Publication No. 10-181177. A cutter home position sensor 49 (see FIGS. 11 and 12) is located at one side of the path MR and responsive to the home position of the cutter 36. The cutter 36 may be replaced with a guillotine type cutter.

The turn roller pair 38 corresponds to a second conveyor roller pair 38 taught in Laid-Open Publication No. 10-181177. The upper and lower turn rollers 38 are a drive roller and a drive roller, respectively. The drive roller 38 is connected to the plotter motor 27M via a solenoid-operated clutch 38C and pulleys and an endless belt or similar drive transmitting means not shown. The solenoid-operated clutch 38C corresponds to a second solenoid-operated clutch 38C taught in the above document. The clutch 380 is selectively coupled to transmit the rotation of the plotter motor 27M to the turn roller pair 38.

The master stocking means 31 includes a solenoid 33S, a suction fan 34 and a fan motor 34M in addition to the previously mentioned box 32 and guide/conveyor plate 33. The master stocking means 31 causes the perforated part of the stencil 22 to bend downward while temporarily accommodating the bend of the stencil 22.

The box 32 is bent in the form of a letter L toward the downstream side of the path MR. The box 32 sequentially accommodates the bent portion of the stencil 22. The guide/conveyor plate 33 is angularly movable between a guiding position and a bending position respectively indicated by a phantom line and a solid line in FIG. 10. The guiding position is such that the plate 33 is positioned horizontally beneath the path MR. The bending position is such that the plate 33 extends vertically downward below the lower turn roller 38. At the bending position, the plate 33 uncovers the top of the box 31 and forms an opening 32*a* for admitting the perforated stencil 22 into the box 31. The plate 33 may be driven by a drive mechanism 130 shown in FIG. 12 of Laid-Open Publication No. 10-202996 mentioned earlier. The solenoid 33S corresponds to a solenoid 131 shown in FIG. 12 of the same document.

Figure 10:
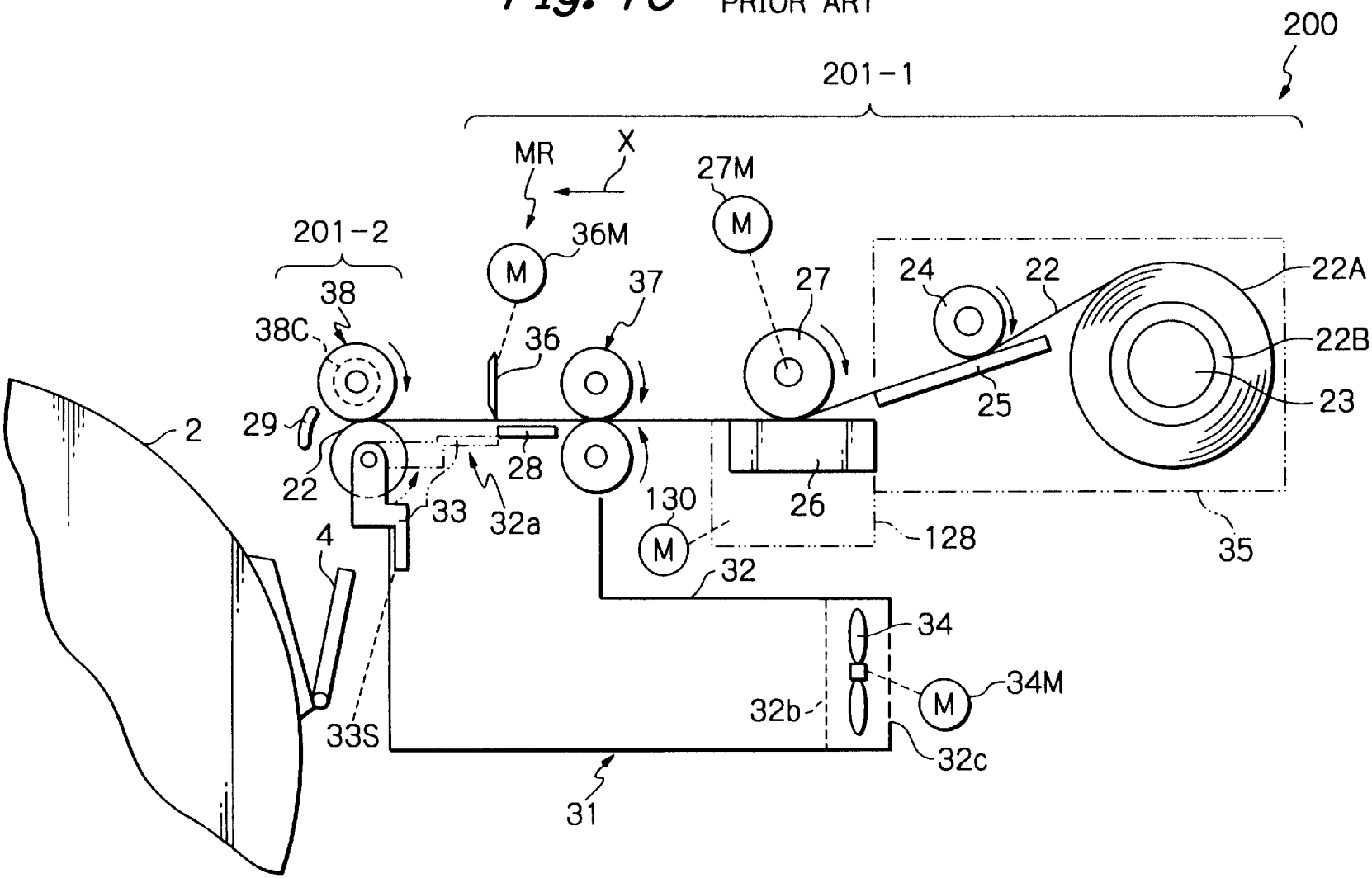
Fig. 10 PRIOR ART
FIG. 10 is a fragmentary enlarged front view showing a conventional master making and feeding device.

After the cutter 36 has cut off the perforated part of the stencil or master 22, the solenoid 33S is turned on to raise the guide/conveyor plate 33 to the guiding position, as shown in FIG. 10. In this position, the guide/conveyor plate 33 guides the leading edge of the master 22 to a stand-by position assigned to master feed, as shown in FIG. 10. The stencil 22 is therefore prevented from dropping into the box 32. As soon as the leading edge of the master 22 is nipped by the turn roller pair 38 at the above stand-by position, the solenoid 33S is turned off. As a result, the guide/conveyor plate 33 is again moved to the bending position due to its own weight and a procedure described in Laid-Open Publication No. 10-202996. The operation of the master stocking means 31 is not shown in FIG. 12 or any one of timing charts pertaining to a preferred embodiment of the present invention, which will be described later.

Suction holes 32*b* and exhaust holes 32*c* are formed in the deepest portion of the box 32 and implemented by, e.g., slits or meshes. The suction fan 34 is positioned between the suction holes 32*b* and the exhaust holes 32*c* and driven by the fan motor 34M. The suction fan 34 in rotation generates a stream of air flowing from the left to the right, as viewed in FIG. 10, causing the master 22 to bend little by little.

The second guide plate 29 steers the leading edge of the master 22 substantially vertically downward. The turn roller pair 38 conveys the master 22 at a slightly higher speed than the platen roller 27.

The plotter motor 27M, platen pressure cancel motor 134, cutter motor 36M, solenoid-operated clutch 38C, fan motor 34 and damper motor 18, which are drive means included in the master making and feeding section 200, are collectively represented by a perforation and feed drive 200A in FIG. 11.

As shown in FIG. 10, the master making and feeding section 200 has a first conveying section 201-1 and a second conveying section 201-2. The first conveying section includes the roll support member 23, stencil set roller 24, guide 25, platen roller 27, plotter motor 27M, drive transmitting means intervening between the plotter motor 27M and the stencil set roller 24, platen roller 27, drive transmitting means intervening between the plotter motor 27M and the platen roller 27, head 26, tension roller pair 37, drive transmitting means intervening between the plotter motor 27M and the tension roller pair 37, cutter 36, and first guide plate 28. The first conveying section 202-1 conveys the stencil 22 to the box 32 mainly for a master making purpose.

The second conveying section 201-2 includes the guide/conveyor plate 33, turn roller pair 38, solenoid-operated clutch 38C, and drive transmitting means intervening between the plotter motor 27M and the turn roller pair 38. The second conveying section 201-2 conveys the stencil 22 accommodated in the box 32 toward the damper 4 of the print drum 2, which is held in an open position.

The master making feeding section 200 includes sensors corresponding in function and configuration to a stencil sensor 32, a stencil set sensor 33 and a lead edge sensor 63 shown in FIGS. 1 and 2 and described in paragraphs (0127) through (0133) of Laid-Open Publication No. 9-226088 mentioned earlier by way of example. Such sensors are collectively represented by stencil sensors 48 in FIG. 11.

Referring again to FIG. 1, the printing section 15 includes an ink feeding device 5 in addition to the print drum 2 and press drum 9. The ink feeding device 5 is arranged in the print drum 2 for feeding ink to the master 22 wrapped around the print drum 2.

The print drum 2 is rotatably mounted on a shaft 3 and made up of a porous cylindrical support and a laminate of mesh screens, not shown, wrapped around the support. A driveline including a main motor 17 causes the print drum 2 to rotate via a gear train and a belt transmission, not shown, at different speeds each implementing a particular printing speed. The main motor or control motor 17 is a DC motor and is isolated from a driveline assigned to the paper feeding system. The main motor 17 is therefore smaller in size than conventional main motors. An encoder, not shown, is mounted on the output shaft of the main motor 17 while an encoder sensor, not shown, is mounted on the body frame 1F in the vicinity of the encoder. The encoder sensor senses pulses output from the encoder representative of the rotation speed of the print drum 2. This allows the rotation speed of the print drum 2 to be controlled via the main motor 17.

The damper 4 is mounted on the outer periphery of the print drum 2 for clamping the lading edge of the master 22 and extends in the axial direction of the print drum 2. The damper 4 includes a rubber magnet. A stage is also mounted on the print drum 2 and formed of a ferromagnetic material. When the print drum 2 is brought to a master discharging position or a master feeding position, an opening/closing device opens the damper 4 away from the stage and then closes it toward the stage. A torsion coil spring or similar biasing means, which surrounds a shaft 4*a*, helps the opening/closing device close the damper 4. The opening/closing device is similar in configuration to a stencil locking device 60 shown in FIGS. 1 through 7 of Laid-Open Publication No. 6-247031 (Japanese Patent Application No. 5-39088) mentioned earlier.

Specifically, the opening/closing device includes a damper drive lever, not shown, affixed to one end of the shaft 4*a*. A master feed positioning pin and a master discharge positioning pin are studded on one end wall of the print drum 2, although not shown specifically. The master feed positioning pin and master discharge positioning pin define the previously mentioned master feeding position and a master discharging position, respectively. An actuator in the form of an arm, not shown, is mounted on the body frame 1F and angularly movable between a first position and a second position. When the print drum 2 is brought to a stop at the master feeding position, the actuator is moved to the first position for opening the damper 4 to a preselected angle in engagement with the damper drive lever. When the print drum 2 is rotated with the damper 4 held in the closed position, the actuator is brought to the second position where it does not engage with the damper drive lever. Another actuator in the form of an arm, not shown, is also mounted on the body frame 1F and angularly movable between a first position and a second position. When the print drum 2 is brought to a stop at the master discharging position, this actuator is also moved to the first position for opening the damper 4 to a preselected angle in engagement with the damper drive lever. The two actuators each are formed with a groove, not shown, engageable with the master feed positioning pin or the master discharge positioning pin when the associated actuator is moving from the second position toward the first position. The damper motor 18 (corresponding to a rack drive motor 45 shown in FIG. 2 of Application No. 6-247031 mentioned earlier) is a single drive means for causing the two actuators to move between the first and second positions at the same time as each other.

A clamper open sensor 81*a* and a clamper close sensor 82*a* (see FIGS. 11 and 12) are mounted on the body frame 1F around one end of the actuator assigned to master discharge when the print drum 2 is held stationary at the master discharging position. These sensors 81*a* and 82*a* are respectively responsive to the open position and closed position of the damper 4. Likewise, a damper open sensor 81*b* and a damper close sensor 82*b* (see FIGS. 11 and 12) are mounted on the body frame 1F around one end of the actuator assigned to master feed when the print drum 2 is held stationary at the master feeding position. These sensors 81*b* and 82*b* are also respectively responsive to the open position and closed position of the damper 4. The sensors 81*a*, 81*b*, 82*a* and 82*b* each are an interruption type optical sensor that turns on when meeting a shield piece protruding from one end of the associated actuator.

A master feed position sensor 13 and a home position sensor 14 (see FIG. 11) are mounted on part of the body frame 1F that faces one end wall of the print drum 2. When the print drum 2 is brought to the master feeding position where the damper 4 is located at the right-hand side, as shown in FIG. 10, the master feed position sensor 13 senses the master feeding position. When the print drum 2 is brought to its home position where the damper 4 is positioned at the bottom of the print drum 2, as shown in FIG. 1, the home position sensor 14 senses the home position. These sensors 13 and 14 each are implemented by a transmission type optical sensor, which may have a configuration shown in FIG. 11 of Laid-Open Publication No. 11-91227 mentioned earlier.

At the master discharging position, the damper 4 on the print drum 2 faces the downstream end of a peel roller 51 and that of a discharge roller 53 in the direction of rotation of the print drum 2. The home position sensor 14 plays the role of sensing means responsive to the master discharging position at the same time. Specifically, the home position sensor 14 turns on when the print drum 2 reaches its home position. The encoder mounted on the output shaft of the main motor 17 determines the amount or angle of rotation of the print drum 2 after the turn-on of the home position sensor 14, thereby detecting the print drum 2 brought to the master discharging position.

As shown in FIG. 1, the ink feeding device 5 is made up of an ink roller 6, a doctor roller 7, and an ink feed pipe 3. The ink roller 6 feeds ink to the inner periphery of the print drum 2. The doctor roller 7 is parallel to and slightly spaced from the ink roller 6 and forms an ink well 8 between it and the ink roller 6. The ink feed pipe 3 feeds ink to the ink well 8 while serving as the shaft 3. The main motor 17 drives the ink roller 6 and doctor roller 7 via gears, belts or similar drive transmitting means. The ink fed from the ink well 8 to the ink roller 6 is applied to the inner periphery of the print drum 2 due to a small gap between the print drum 2 and the ink roller 6. An ink pump, not shown, delivers ink under pressure from an ink pack, not shown, located at a suitable position to the ink well 8 via holes formed in the ink feed tube 3.

The press drum or pressing means 9 is rotatable at the same peripheral speed as the print drum 2 in synchronism with the print drum 2. The press drum 9 presses the paper sheet S, which is fed from the paper feeding section 40, against the print drum 2 while clamping the leading edge of the sheet S with a damper 12. The press drum 9 is identical in outside diameter with the print drum 2. A recess 11 is formed in part of the circumference of the press drum 9 so as to avoid interference with the damper 4 of the print drum 2. The damper 12 opens and closes in contact with a cam, not shown, mounted on the body frame 1F.

When the paper sheet S is a plain paper or a thin paper, the damper 12 clamps the leading edge of the paper sheet S over about 2 mm. However, when the paper sheet S is, e.g., relatively thick, the damper 12 does not clamp it. A thick paper, which is relatively stiff or rigid, would prevent the damper 12 from fully closing due to its reaction and cause the edge of the damper 12 to hit against the master 22 and mesh screen present on the print drum 2, causing the ink to fly about.

A cam drive mechanism, not shown, causes a shaft 10, on which the press drum 9 is mounted, to angularly move such that the press drum 9 selectively contacts the print drum 2. An arm, spring or similar biasing means, and a solenoid, not shown, constitute holding means for holding the press drum 9 rotatable at a position spaced from the print drum 2. The cam drive mechanism and holding means constitute conventional press drum moving means. The driveline including the main motor 17, press drum moving means and so forth are shown in, e.g., FIGS. 1 through 5 of Laid-Open Publication No. 9-216448 mentioned earlier. The press drum moving means may have a configuration shown in, e.g., FIG. 1 of Laid-Open Publication No. 5-201115 and including an eccentric shaft. The pressing means may be implemented by a conventional press roller.

The drive means around the print drum 2, including the main motor 17 and the drive means of the press drum moving means, are collectively represented by a print drum drive 16 in FIG. 11.

The paper feeding section 40 includes a pickup roller 42, cooperative separator rollers 43 and 43*a*, guides 45*a* and 45*b*, a registration roller pair 44 and a tray motor, not shown, in addition to the previously mentioned tray 41. The tray 41 loaded with the sheet stack S is mounted on the body frame 1F in such a manner as to be movable up and down. A tray motor, not shown, raises or lowers the tray 41 in accordance with the number of paper sheets S present on the tray 41.

The pickup roller 42 rests on the top paper sheet S and pays it out of the tray 41. The separator rollers 43 and 43*a* cooperate to separate the top sheet S paid out by the pickup roller 42 from the underlying paper sheets S. The pickup roller 42 and separator rollers 43 and 43*a* constitute paper feeding means for feeding the paper sheets S one by one. A paper feed motor 42M rotates the pickup roller 42 and separator roller 43 via drive transmitting means including pulleys and an endless belt not shown. The paper feed motor 42M is implemented by a stepping motor. The paper feed motor 42M drives the paper feeding means independently of the main motor 17 and replaces the conventional sector gear type of drive system.

A one-way clutch, not shown, intervenes between each pulley and each roller shaft described above. When the paper feed motor 42M is not energized, each roller is freely rotatable in the direction in which the paper sheet S is to be paid out. Therefore, when only a registration motor 44M, which will be described later, is energized, the rollers 42 and 43 are rotated by the paper sheet S being paid out.

The registration roller pair or paper conveyance synchronizing means 44 is positioned downstream of the separator roller 43 in the direction of paper conveyance. The leading edge of the paper sheet S fed from the tray 41 abuts against part of the registration roller pair 44 just before the nip of the roller pair 44. The registration roller pair 44 then conveys the paper sheet S in synchronism with the image start position or perforation start position of the master 22 wrapped around the drum 2 that is in rotation, as well as the damper 12 held open at that time. The upper and lower registration rollers 44 are a driven roller and a drive roller, respectively. The registration motor 44M, which is a stepping motor, drives the drive roller 44 via drive transmitting means including pulleys and an endless belt not shown. The registration motor 44 drives the registration roller pair 44 independently of the main motor 17 and replaces the conventional sector gear type of drive system.

The guides 45*a* and 45*b* are affixed to opposite side walls of the apparatus body for guiding the paper sheet S being conveyed. When use is made of a press drum lacking the damper 12 or the conventional press roller, the paper sheet S may be fed to a gap between the print drum 2 and the press drum or the press roller in synchronism with the image start position of the master 22 wrapped around the print drum 2. The registration roller 44M for driving the registration roller pair 44 may be replaced with mechanical drive means using a cam. The paper feed motor 42M, registration motor 44M and tray motor included in the paper feeding section 40 are collectively represented by a paper feed drive 46 in FIG. 11.

The paper discharging section 60 includes a peeler 62, an inlet roller 63, an outlet roller 64, a belt 65, a suction fan 66, a paper discharge motor, not shown, and a fan motor, not shown, in addition to the previously mentioned tray 61. The peeler 62 adjoins the press drum 9 and peels off the paper sheet S from the press drum 9 when the clamper 12 is opened. The inlet roller 63 and outlet roller 64 are rotatably supported by opposite side walls, not shown, of the paper discharging section 60. The belt 65 is passed over the two rollers 63 and 64 and formed with a plurality of holes. The paper discharge motor mentioned earlier drives the outlet roller 64. The rotation of the outlet roller 64 is transferred to the inlet roller 63 by the belt 65. The suction fan 66 is position beneath the belt 65 between the rollers 63 and 64 and driven by the fan motor. The suction fan 66 in rotation generates a stream of air flowing downward, as viewed in FIG. 1, to thereby suck the paper sheet S being conveyed by the belt 65. The operation of the paper discharging section 60 is not shown in FIG. 12 or any one of the timing charts pertaining to the illustrative embodiment, which will be described later.

To prevent the paper sheet S from rolling up onto the print drum 2 due to the defective release of the paper sheet S from the damper 12, there may be used an additional peeler and a fan not shown. The additional peeler is movable toward and away from the print drum 2 for peeling off the paper sheet S form the print drum 2. The peel fan sends air to between the master 22 on the print drum 2 and the paper sheet S for promoting the peeling of the paper sheet S from the print drum 2.

The fan motor and other drive means included in the paper discharging section 60 are collectively represented by a paper discharge drive 67 in FIG. 11.

The master discharging section 50 includes a master discharge motor 52, a compressing plate, not shown, and a plate motor, not shown, in addition to the box 54, peel roller 51, and discharge roller 53. The peel roller 51 is held in pressing contact with the discharge roller 53 and driven by the master discharge motor 52. Moving means including a movable arm causes the peel roller 51 to move between an operative position where it contacts the press drum 2 and an inoperative position where the former is spaced from the latter. When the peel roller 51 is located at the inoperative position, locking means, not shown, locks it at the inoperative position. The moving means and locking means may be constructed as shown in, e.g., FIGS. 1 through 5 of Utility Model Publication No. 2-274 mentioned earlier. The compressing plate is disposed in the box 54 and movable up and down by being driven by an elevating mechanism, which is driven by the plate motor. The discharge motor 52, plate motor and other drive means included in the master discharging section 50 are collectively represented by a master discharge drive 56 in FIG. 11.

Figure 3:
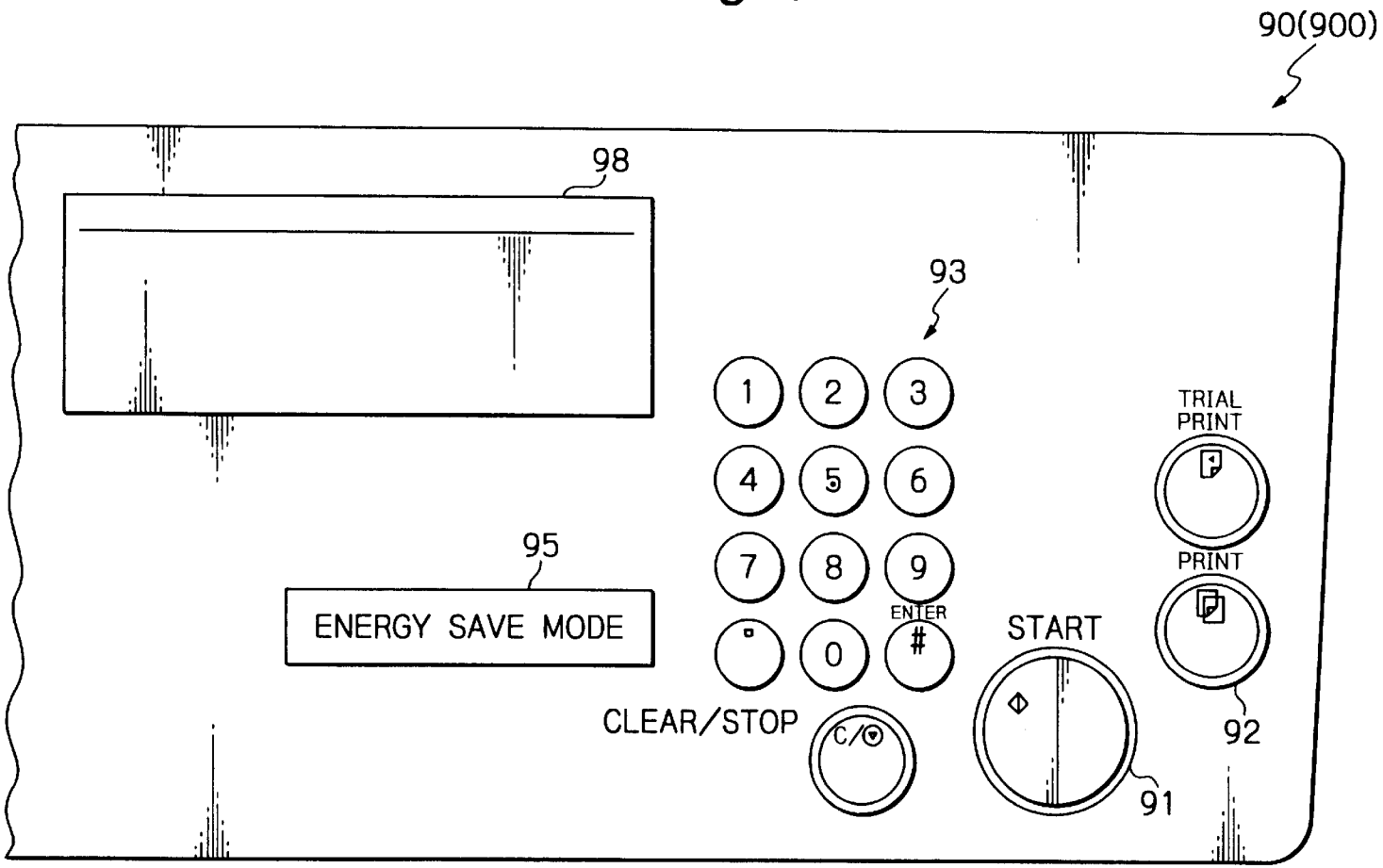
FIG. 3 is a fragmentary plan view showing an operation panel included in the stencil printer.

Reference will be made to FIG. 3 for describing an operation panel designated by the parenthesized reference numeral 900. The operation panel 900 is positioned above and at one side of the document reading section 70, FIG. 1. As shown, the operation panel 900 includes a start key or operation starting means 91 for starting a sequence beginning with image reading and ending with paper discharging. Numeral keys 93 allow the operator of the printer 1,000 to input, e.g., a desired number of prints. A print key 92 is operated to start a printing operation that should be repeated to output the desired number of prints. An LCD (Liquid Crystal Display) 98 displays the statuses of the printer 1,000, alarm messages and other messages, functions selected, and so forth. It should be noted that an energy save mode key 95 is not present on the conventional operation panel 900, but is used in the illustrative embodiment of the present invention to be described later.

An LCD driver, not shown, drives the LCD 98. Mode keys 99 and mode lamps 99G shown in, e.g., FIG. 3 of Laid-Open Publication No. 10-181177 mentioned earlier are additionally included in the operation panel 900, although not shown or described for the simplicity of description. The high-speed mode 1 taught in the above document is assumed to be set at first. This is also true with the illustrative embodiment to be described later. The high-speed mode 1 is the initial mode automatically set without any mode key being pressed. Specifically, in this mode, an operation for discharging a used master is interrupted when the leading edge of a new master 22 is brought to the stand-by position for clamping its leading edge on the print drum 2. After the leading edge of the new master 22 has been clamped on the print drum 2, the discharging operation is resumed with the new master 22 being sequentially wrapped around the drum 2. At the same time, the ink is fed to the new master 22 for printing an image on the paper sheet S.

A power switch 80 is mounted on the body frame 1F in the vicinity of the operation panel 900. When the power switch 80 is pressed, power is fed to the main control unit 500, operation panel 900 and various drive means in order to make them operable or ready to operate.

Referring to FIG. 11, the main control unit 500 includes a CPU (Central Processing Unit), I/O (Input/Output) ports, a ROM (Read Only Memory), a RAM (Random Access Memory), a timer and so forth, although not shown specifically. Such components of the main control unit 500 are interconnected by a signal bus, not shown, constituting a microcomputer. The main control unit 500 interchanges, via the I/O ports, command signals, ON/OFF signals and data signals with the paper feed position sensor 13, home position sensor 14, platen pressure cancel sensors 81*b*, damper close sensors 82*b*, power switch 80, scanning drive 78, operation panel 900, perforation controller 19, master discharge drive 56, print drum drive 16, paper feed drive 46 and paper discharge drive 46 as well as with the perforation and feed 200A. The main control unit 500 controls the starts and stops of drive of the various drive means included in the printer 1,000 as well as their timings.

Figure 12:
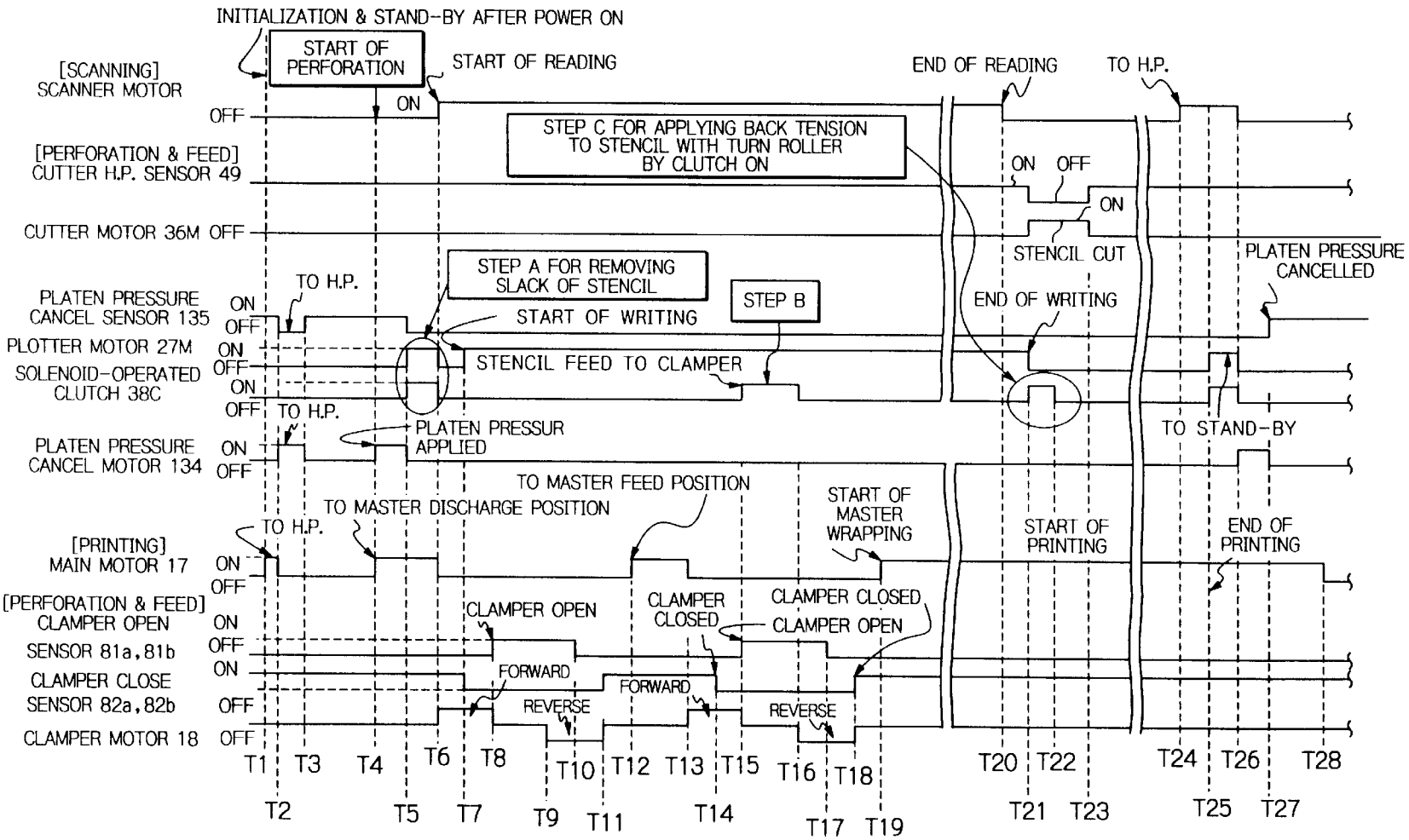
FIG. 12 is a timing chart representative of a first conventional specific procedure.

The ROM stores programs and data for executing the operation of the printer 1,000 in accordance with a timing chart shown in FIG. 12. The RAM is used to store interim calculation results output from the CPU and ON/OFF signals and data signals output from the sensors and keys.

Reference will be made to FIG. 12 for describing a first specific conventional procedure available with the printer 1,000. The timing chart of FIG. 12 and timing charts of the other figures each suitably omit or slightly exaggerate the procedure to a degree that does not hinder the understanding the operation of the printer 1,000 (or 1). Because the operation of the printer 1,000 (or 1) is effected under the control of the main control unit 500 (or 120), details of the operation will be suitably omitted. While the abscissa of each timing chart indicates time, the actual length in the timing chart does not mean actual duration, but simply shows that time sequentially expires as the suffix attached to time T increases.

As shown in FIG. 12, when the operator presses the power switch 80, the printer 1,000 is initialized to set up the high-speed mode 1. The main motor 17 ant that of the print drum 2 may have not been located at the respective home positions at the end of the last operation of the printer 1,000. In light of this, the main motor 17 is turned on (ON) to locate the print drum 2 at the home position (H. P) from time T1 to time T2. Also, the platen pressure cancel motor 134, which may not have been located at the home position, is returned to its home position during the interval between times T1 and T2. Specifically, the motor 134 is caused to make one rotation and then turned off (OFF) when the platen pressure cancel sensor 135 senses the cancellation of the platen pressure.

The loading and unloading operations of the stencil roll 22A, which may be performed before or after the operation of the power switch 80, are described in detail paragraphs (1047) through (0166) of Laid-Open Publication No. 9-226088 by way of example.

Figure 13:
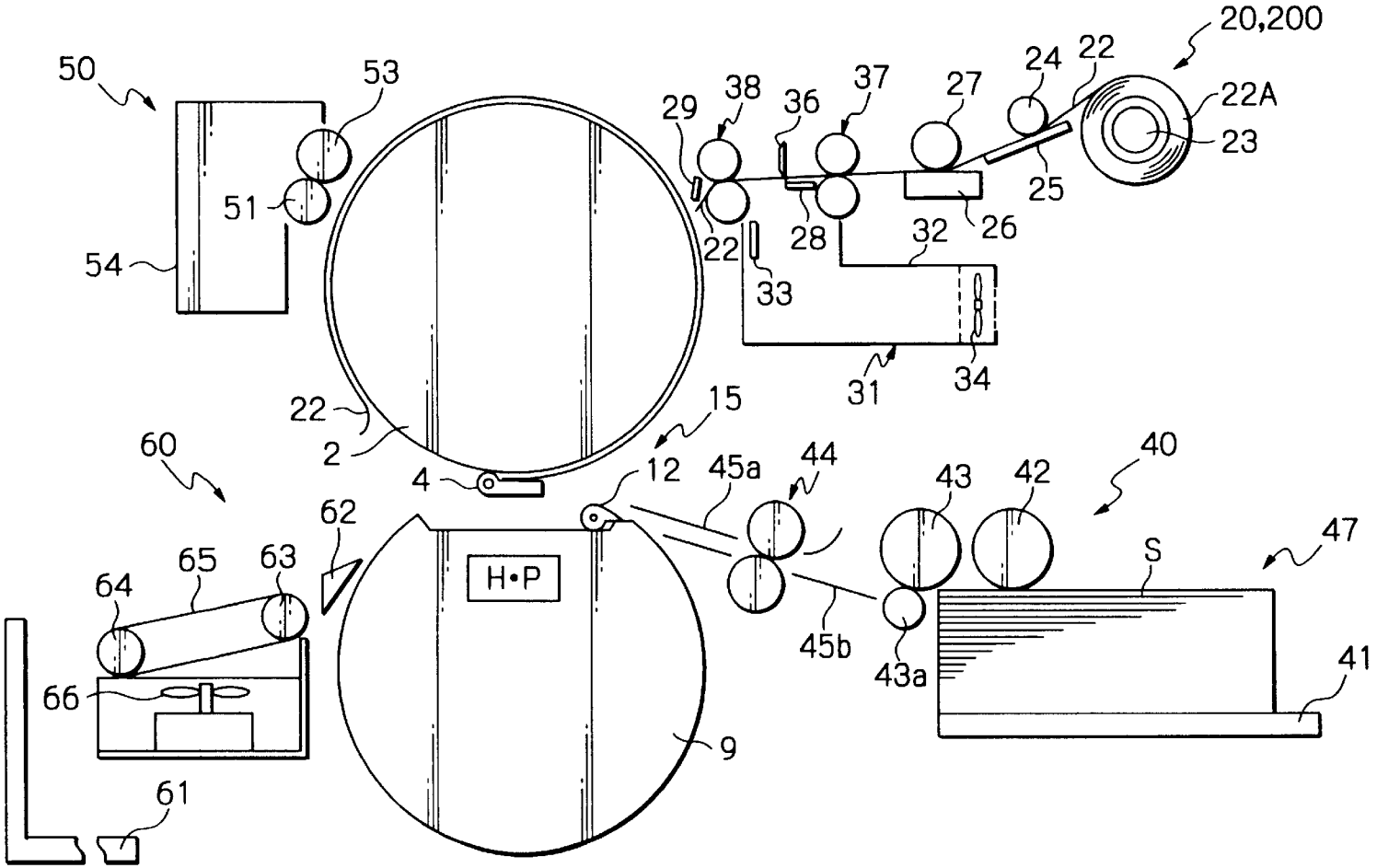
FIG. 13 is a front view showing an initial state for describing the first specific operation of the illustrative embodiment and the first conventional specific procedure.

FIG. 13 shows the initial condition of the printer 1,000. As shown, in the master making and feeding section 200, the leading edge of the stencil 22 paid out from the roll 22A is nipped by the turn roller pair 38 at the stand-by position. The print drum 2 and press drum 9 each are held at the respective home position (H. P). The operator stacks the documents 73, FIG. 1, on the tray 72 of the scanning section 70, FIG. 1, while supplementing or setting the paper stack S on the tray 41, FIG. 1, if necessary.

At time T4 shown in FIG. 12, when the operator turns on the start key 91, the start key 91 sends a perforation start signal to the main control unit 500. In response, the main control unit 500 executes the sequence beginning with image reading and ending with paper discharge. In this sense, the perforation start signal triggers the operation to follow. Manual operation ends when the operator presses the start key 91. The ink feeding device 5 feeds ink to form the ink well 8. The elevation motor of the paper feeding section 46 is turned on to set a preselected paper feed pressure and a preselected separation pressure.

As shown in FIGS. 1 and 13, when the main motor 17 is turned on at time T4, it starts rotating the print drum 2 having a used master wrapped therearound and held at the home position clockwise. In response, the home position sensor 14 outputs an OFF signal and sends it to the main control unit 500. The main control unit 500 controls, based on the OFF signal and the output signal of the encoder, the main motor 17 such that the print drum 2 stops at the master discharging position. During master discharge and master feed, the solenoid of the holding means included in the print drum drive 16 remains in an OFF state, so that the print drum 2 rotates without contacting the press drum 9.

Figure 15:
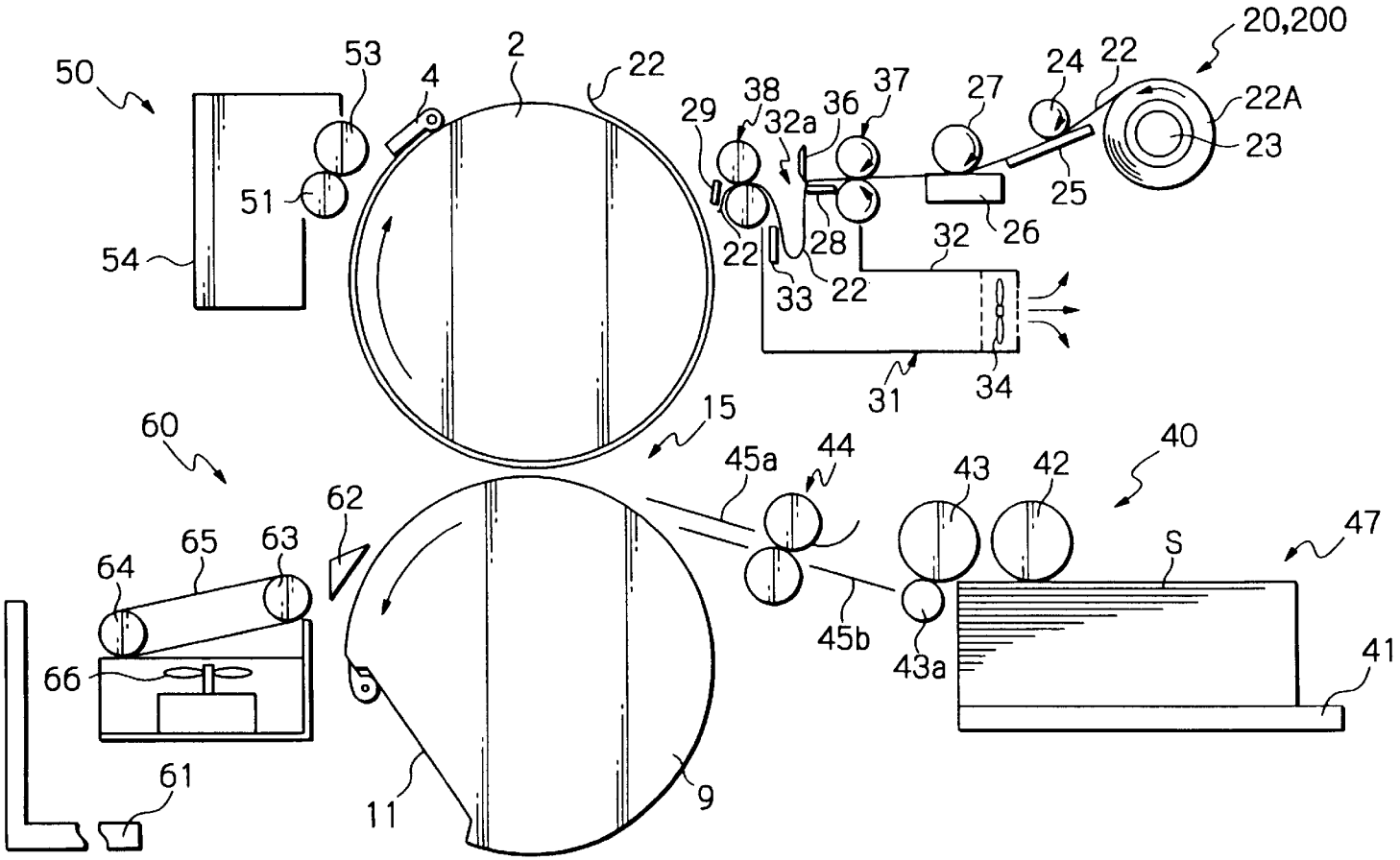
FIG. 15 is a fragmentary front view showing the rotation of a print drum to a master discharging position for describing the first specific procedure of the illustrative embodiment and the first conventional specific procedure.
Figure 16:
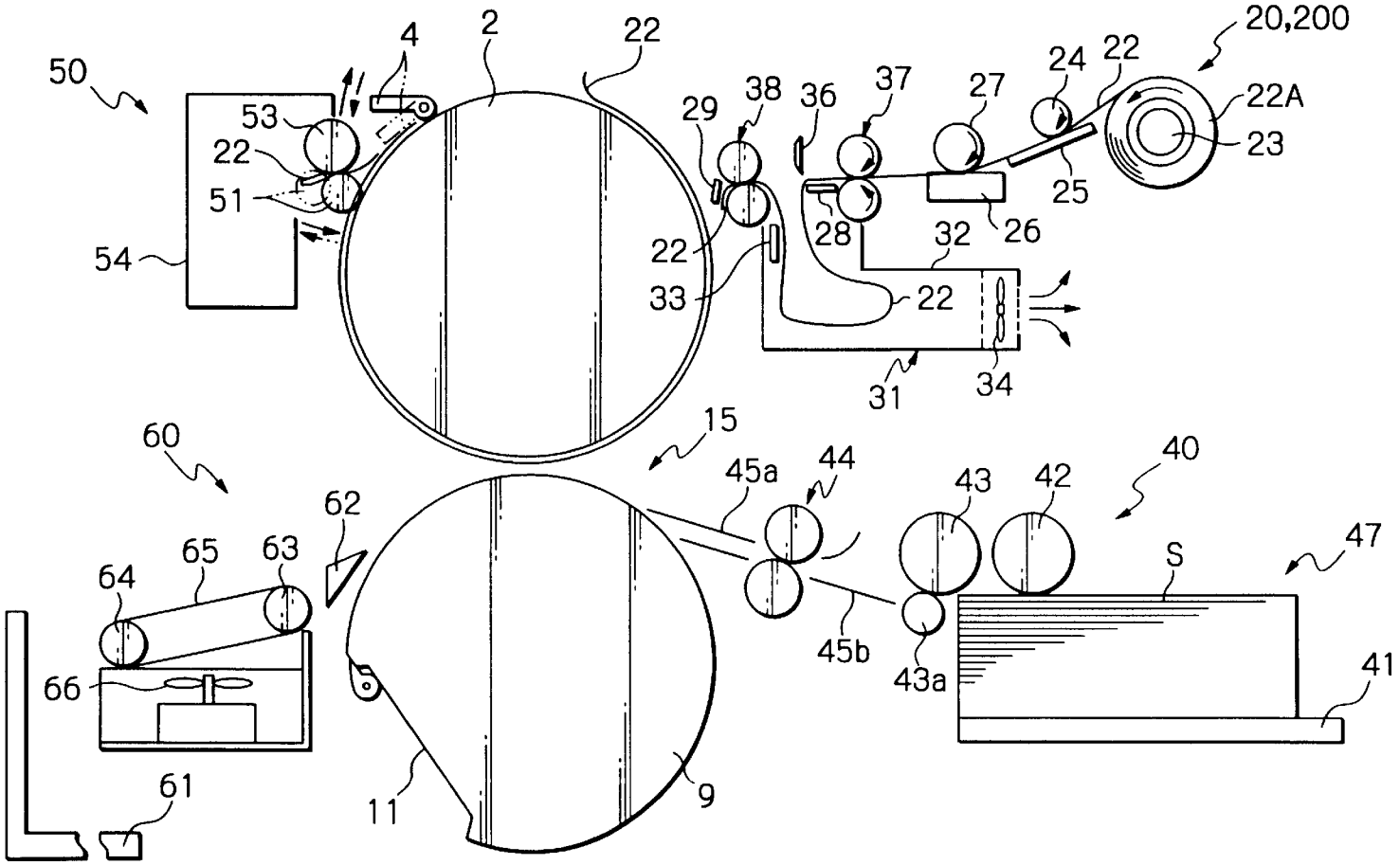
FIG. 16 is a fragmentary front view showing the preparation for master discharge effected in parallel to the perforation of a stencil and relating to the first specific procedure of the illustrative embodiment and the first conventional procedure.

The main motor 17 is turned off at time T6. As a result, the print drum 2 is brought to a stop at the master discharging position, as shown in FIG. 15 also. The main control unit 500 then turns on the damper motor 18 at time T6 and causes it to rotate up to time T8 in the forward direction until the damper 4 opens by the preselected angle, as shown in FIG. 16 also. At this instant, the shield piece of the actuator assigned to master discharge meets the damper open sensor 81*a* and turns it on. The sensor 81*a* therefore senses the open position of the damper 4 (times T8 through T10). The main control unit 500 stops energizing the damper motor 18 at time T8 and maintains it deenergized up to time T9.

The locking means unlocks the moving means to thereby move the peel roller 51 to the operative position indicated by a solid line in FIG. 16. At the same time, the discharge motor 52 is turned on. As a result, the peel roller 51 is rotated and pressed against part of the print drum 2 where the leading edge of the used master 22 is present, scooping up the leading edge away from the print drum 2. Just after such a peeling operation, the moving means returns the peel roller 51 to the inoperative position indicated by a phantom line in FIG. 6. At the inoperative position, the peel roller 51 is held in a freely rotatable state together with the discharge roller 53. At time T9 just after the return of the peel roller 51, the damper motor 18 is turned on at time T9 and rotated in the reverse direction up to time T11 in order to close the damper 4. Consequently, one end of the actuator assigned to master discharge and the damper drive lever are released from each other, so that the damper 4 is closed due to the action of the torsion coil spring and rubber magnet. At this instant, the shield piece of the actuator leaves the damper open sensor 81*a*, turning off the sensor 81*a* at time T10. Subsequently, one end of the actuator meets the damper close sensor 81*b* and senses the closed position of the clamper 4 at times T11 through T14.

After the damper 4 has been closed at time T12, the main motor 17 is turned on to rotate the print drum 2 clockwise. At this time, the substantial master discharging operation begins. Specifically, the peel roller 51 and discharge roller 53 in rotation nip the used master 22, whose leading edge has been separated from the print drum 2, and conveys the master 22 to the box 54 while peeling it off from the print drum 2. As a result, the used master 22 is discarded into the box 54 as a waste master.

On the other hand, just after the output of the perforation start signal (time T4), the master making and feeding section 200 has its platen pressure cancel motor 134 turned on. As a result, a platen pressure acts on the stencil 22 between the platen roller 27 and the head 26. The platen pressure cancel sensor 135 then turns off at time T5.

Figure 14:
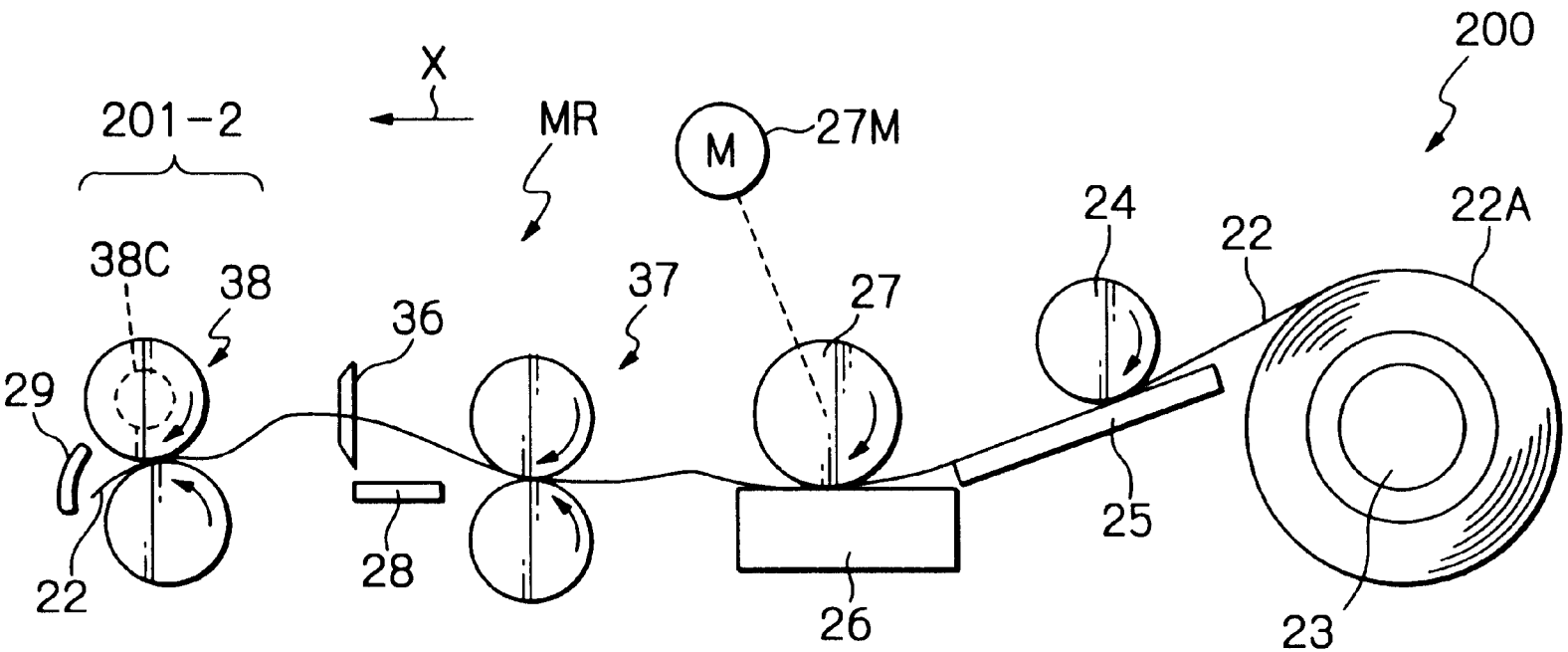
Fig. 14 PRIOR ART
FIG. 14 is a fragmentary enlarged view demonstrating how the first conventional specific procedure removes the slack of a stencil in a stand-by state before perforation.

However, in the stand-by condition up to time T5, the platen pressure is continuously cancel led, i.e., the platen pressure cancel sensor 135 remains in an ON state from time T3 to time T5. Therefore, the platen roller 27 and head 27 are spaced from each other, and so are the upper and lower tension rollers 38. Consequently, as shown in FIG. 14, part of the stencil 22 extending between the stencil set roller 24 and the turn roller pair 38 on the path MR slackens. Should the slackened stencil 22 be wrapped around the print drum 2, it would crease or would make the perforation start position unstable. To solve this problem, just after the application of the platen roller, all the rollers of the first and second conveying sections 201-1 and 201-2 should be rotated to convey the stencil 22 by a small distance (about 5 mm to 8 mm) until the leading edge of the stencil 22 protrudes toward the damper 4 over the stand-by position.

For this purpose, the plotter motor 27M and clutch 38C are turned on at time T5 and continuously turned on up to time T6. As a result, all of the stencil set roller 24, platen roller 27, tension roller pair 37 and turn roller pair 38 are rotated to remove the slack of the stencil 22.

In parallel with the rotation of the print drum 2 to the master discharging position and master discharging operation, the document reading section 70 and master making and feeding section 200 respectively start a document reading operation and a master making (writing) operation at times T6 and T7. Specifically, the scanning drive 78 causes the lowermost document 73 stacked on the tray 72 to be automatically conveyed to a preselected position on the glass platen 74. The optics reads the image of the document 73 laid on the glass platen 74. An analog image signal output from the image sensor 77 and representative of the document image is input to the ADC section. After the document 73 has been fully scanned, it is driven out to the tray 75. The ADC section converts the analog image signal to a digital image signal and sends the digital image signal to the perforation controller 19 via a signal processing section not shown.

While the optics is scanning the document 73, the main control unit 500 causes the perforation controller 19 to control the head 26 in accordance with the digital image signal and controls the master discharging drive. As a result, a master making operation and a master discharging operation proceed in parallel. More specifically, while the head 26 presses the stencil 22 against the platen roller 27, the heat generating elements of the head 26 are selectively energized to heat and thereby perforate the thermoplastic resin film of the stencil 22. At the same time, the plotter motor 27M is turned on at time T7 in order to rotate the platen roller 27 and tension roller pair 37 in directions indicated by arrows. Consequently, the perforated part of the stencil 22 is conveyed to the downstream side on the path MR. Because the clutch 38C is turned off at time T6, the rotation of the plotter motor 27M is not transferred to the turn roller pair 38.

At the same time as the conveyance of the stencil 22, the fan motor 34M is turned on to rotate the suction fan 34. The resulting air stream flowing from the left to the right, as stated earlier, causes the perforated part of the stencil 22 to hang down into the box 32 via the opening 32*a* while bending. In this manner, the perforated stencil 22 is sequentially accommodated in the box 32.

Figure 17:
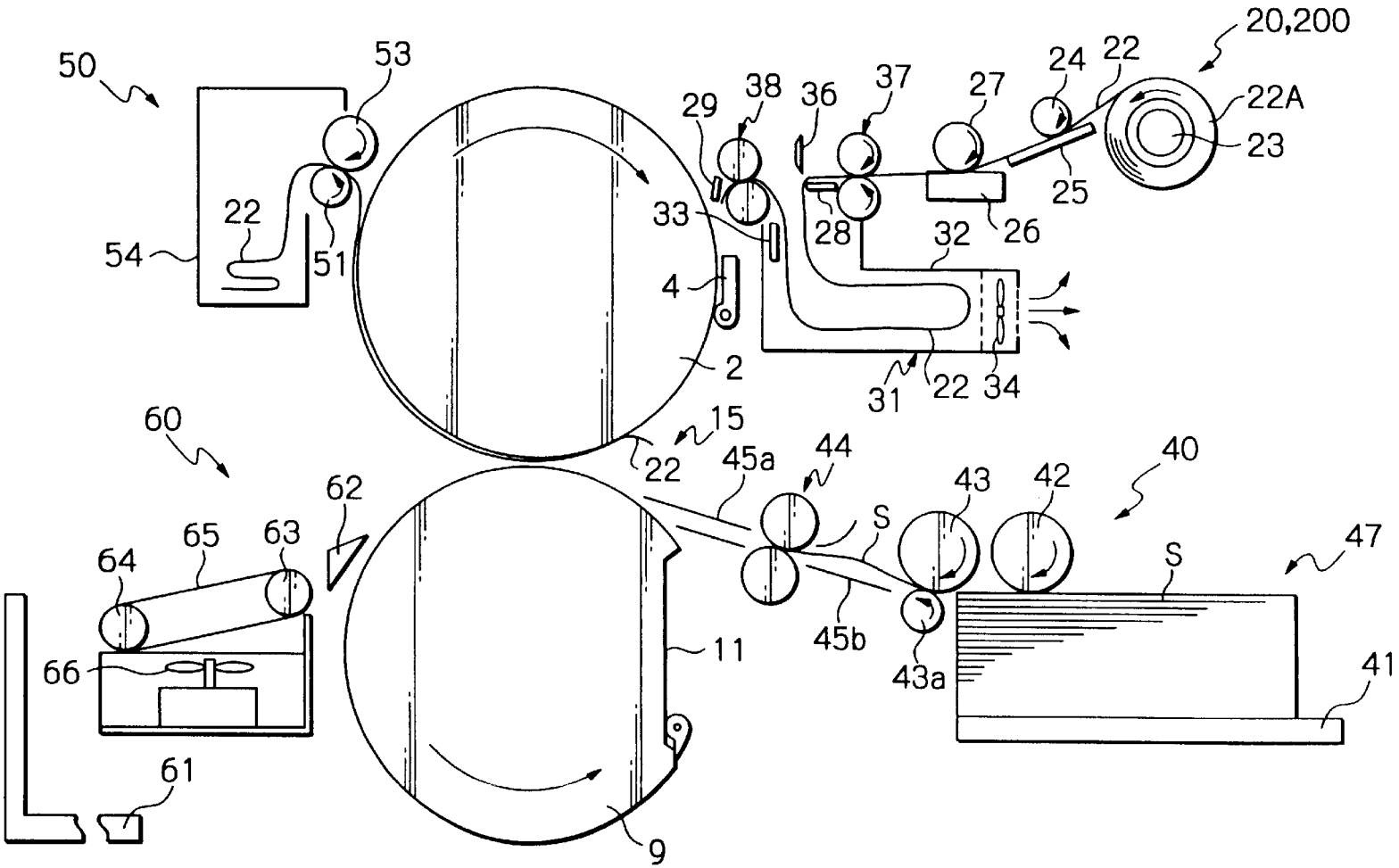
FIG. 17 is a fragmentary front view showing the preparation for master discharge and paper feed effected in parallel to the perforation of a stencil and relating to the first specific procedure of the illustrative embodiment and the first conventional procedure.

The main motor 17 is turned on at time T12. As shown in FIG. 17, the main motor 17 causes the print drum 2 to rotate clockwise. The main motor 17 is then turned off at time T13, causing the print drum 2 to stop at the master feeding position. During the interval between times T12 and T13, the peel roller 51 and discharge roller 53 of the master discharging section 50 are continuing the master discharging operation. As a result, the used master 22 is peeled off from the print drum 2 by an amount corresponding to the amount of rotation of the print drum 2 and is dumped into the box 54. During the above interval, the master making and feeding section 200 has the plotter motor 27M held in an ON state and causes the master stocking means 31 to continue the master making operation while causing the stencil 22 to bend.

During the interval between times T12 and T13, the master making (writing) operation proceeds while the print drum 2 rotates toward the master feeding position. At the same time, the paper feed motor 42 of the paper feeding section 40 is turned on to rotate the pickup roller 42 and separator roller pair 43. The rollers 42 and 43 cooperate to pay out the top paper sheet S until the leading edge of the paper sheet S abuts against a portion of the registration roller pair 44 just short of the nip. Subsequently, the paper feed motor 42M is turned off to stop the rotation of the pickup roller 42 and separator roller pair 43. As a result, the leading edge of the paper sheet S abuts against the nip of the registration roller pair 44 and is held thereby. The trailing edge of the paper sheet S is still nipped by the pickup roller 42 and separator roller pair 43.

When the print drum 2 is brought to a stop at time T13, the damper motor 18 is turned on in order to open the damper 4 and rotates in the forward direction from time T13 to time T15. As a result, the damper 4 is immediately opened to the preselected angle to prepare for the arrival of the stencil 22. At this instant, after one end of the actuator assigned to master feed has engaged with the damper drive lever and opened the damper 4 to the preselected angle, the shield piece protruding from one end of the actuator meets the clamper open sensor 82*a* and turns it on. The damper 4 remains open from time T15 to time T17. The damper motor 18 is turned off at time T15 and remains in an OFF state up to time T16. In this condition, the print drum 2 waits for the arrival of the stencil 22.

In the above condition, the solenoid-operated clutch 38C is coupled to transfer the rotation of the plotter motor 27M to the turn roller pair 38 via the drive transmitting means. The turn roller pair 38 conveys the leading edge of the perforated part of the stencil 22 to the damper 4 via the second guide 29. The leading edge of the stencil 22 is determined to have reached the damper 4 at time T16 on the basis of the number of steps of the plotter motor 27M. At this time, the clutch 38C is uncoupled to stop the rotation of the turn roller pair 38. The damper motor 18 is again turned on and caused to rotate in the reverse direction from time T16 to time T18. As a result, one end of the actuator assigned to paper feed is released from the damper drive lever and causes the damper 4 to close under the action of the torsion coil spring and rubber magnet. At this instant, the shield piece of the actuator leaves the damper open sensor 82*a* and causes it to turn off at time T17. Subsequently, the shield piece meets the damper close sensor 82*b*. The clamper close sensor 82*b* therefore senses the closed position of the damper 4. The damper remains closed after time T18.

Figure 18:
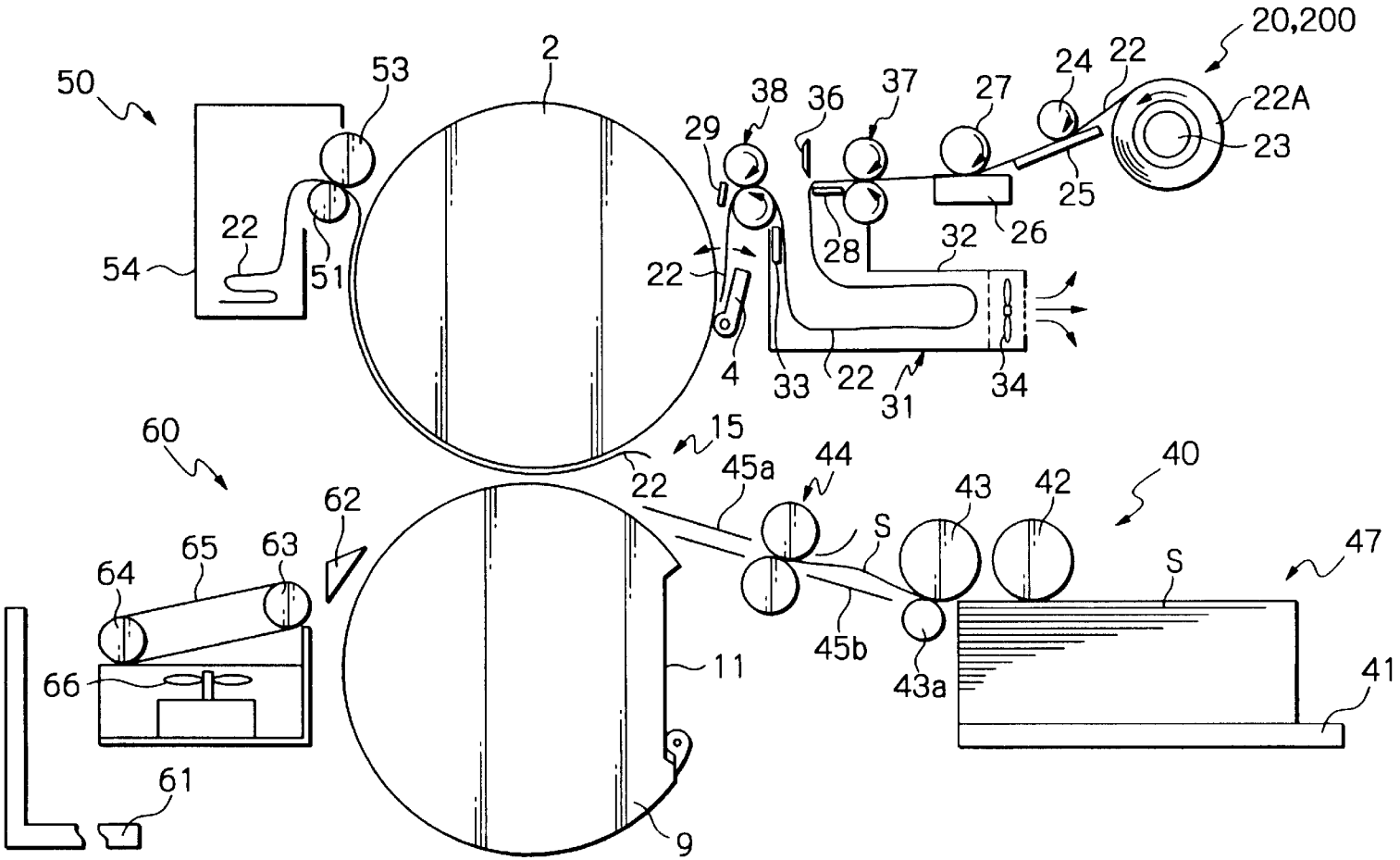
FIG. 18 is a fragmentary front view showing the preparation for master feed effected in parallel to the perforation by interrupting the master discharge and relating to the first specific procedure of the illustrative embodiment and the first conventional procedure.

As shown in FIG. 18, while the print drum 2 is waiting for the arrival of the stencil 22 from time T13 to time T19, the master discharging operation of the peel roller 51 and discharge roller 53 is interrupted. At time T16, the damper 4 is closed and clamps the leading edge of the stencil 22.

Figure 19:
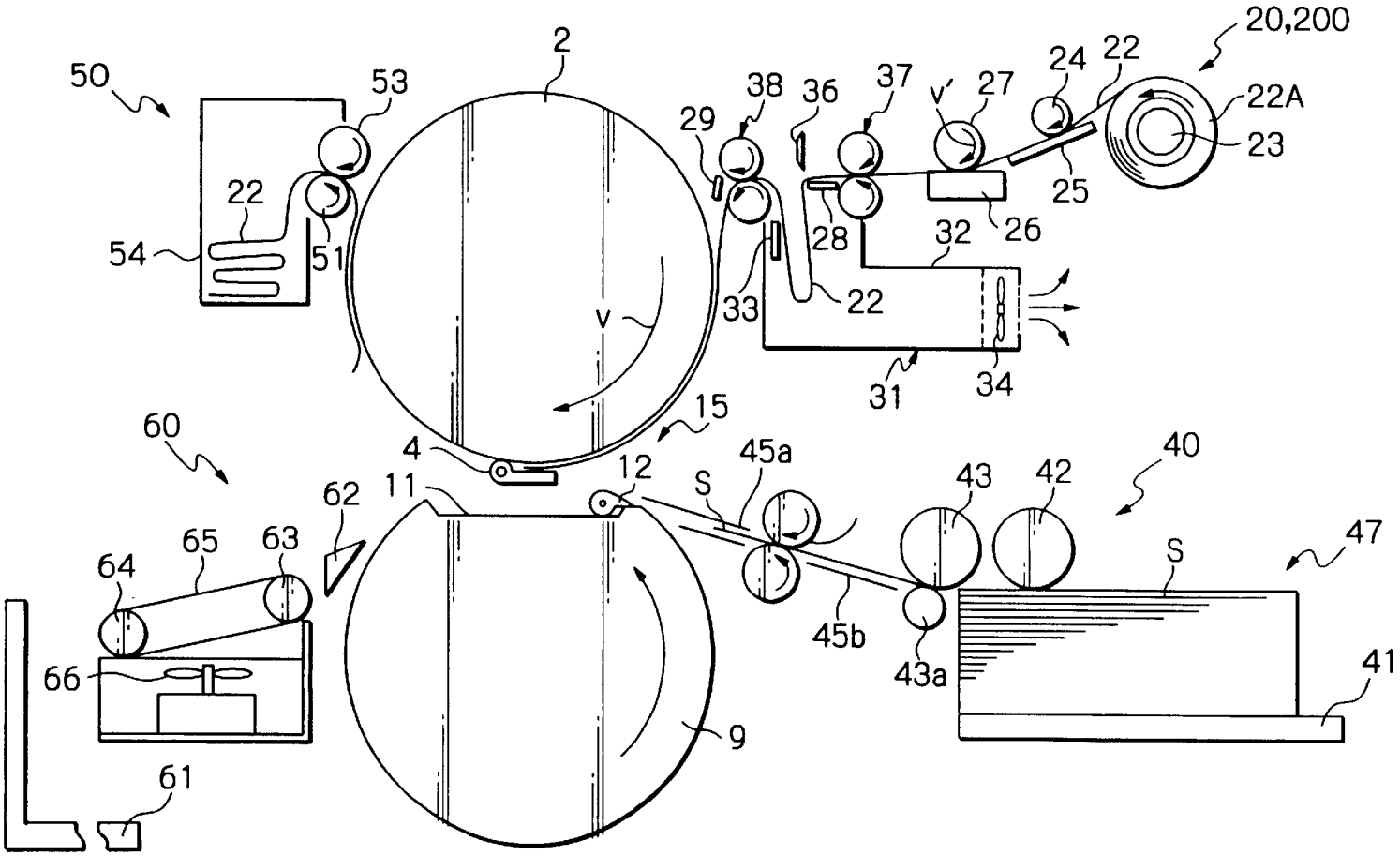
FIG. 19 is a fragmentary front view showing the master feed effected in parallel to the perforation and master discharge as well as paper feed effected in parallel to them and relating to the first specific procedure of the illustrative embodiment and the first conventional procedure.

As shown in FIG. 19, a master wrapping operation begins at time T19. Specifically, the main motor 17 is turned on to rotate the print drum 2 clockwise. The print drum 2, in turn, causes the turn roller pair 38 to rotate and pull the stencil 22 out of the box 32. The stencil or master 22 is sequentially wrapped around the print drum 2. At this instant, the turn roller 38 exerts a load on the stencil 22 and thereby causes a preselected degree of tension to act on the master 22. This is successful to prevent the master 22 being wrapped around the print drum 2 from creasing or otherwise deforming. The main control unit 500 controls the rotation speed of the main motor 17 and that of the plotter motor 27M such that the peripheral speed v of the print drum 2 is sufficiently higher than the speed v' at which the platen roller 27 conveys the stencil 22 (v>v').

At the same time as the master feeding operation begins, the master discharge motor 52 is turned on to resume the master discharging operation. Specifically, the motor 52 causes the peel roller 51 and discharge roller 53 to peel off the used master 22 from the print drum 2 by an amount corresponding to the amount of rotation of the print drum 2. The used master 22 is conveyed to and discarded into the box 54.

The document reading operation of the document reading section 70 ends at time T20. When the main control unit 500 determines, based on the number of steps of the plotter motor 27M, that a single master has been fully formed in the stencil 22, it turns off the plotter motor 27M and fan motor 34M at time T21. As a result, the stencil set roller 24, platen roller 27, tension roller pair 37 and suction fan 34 stop rotating and end the master making (writing) operation (see FIG. 20).

Figure 20:
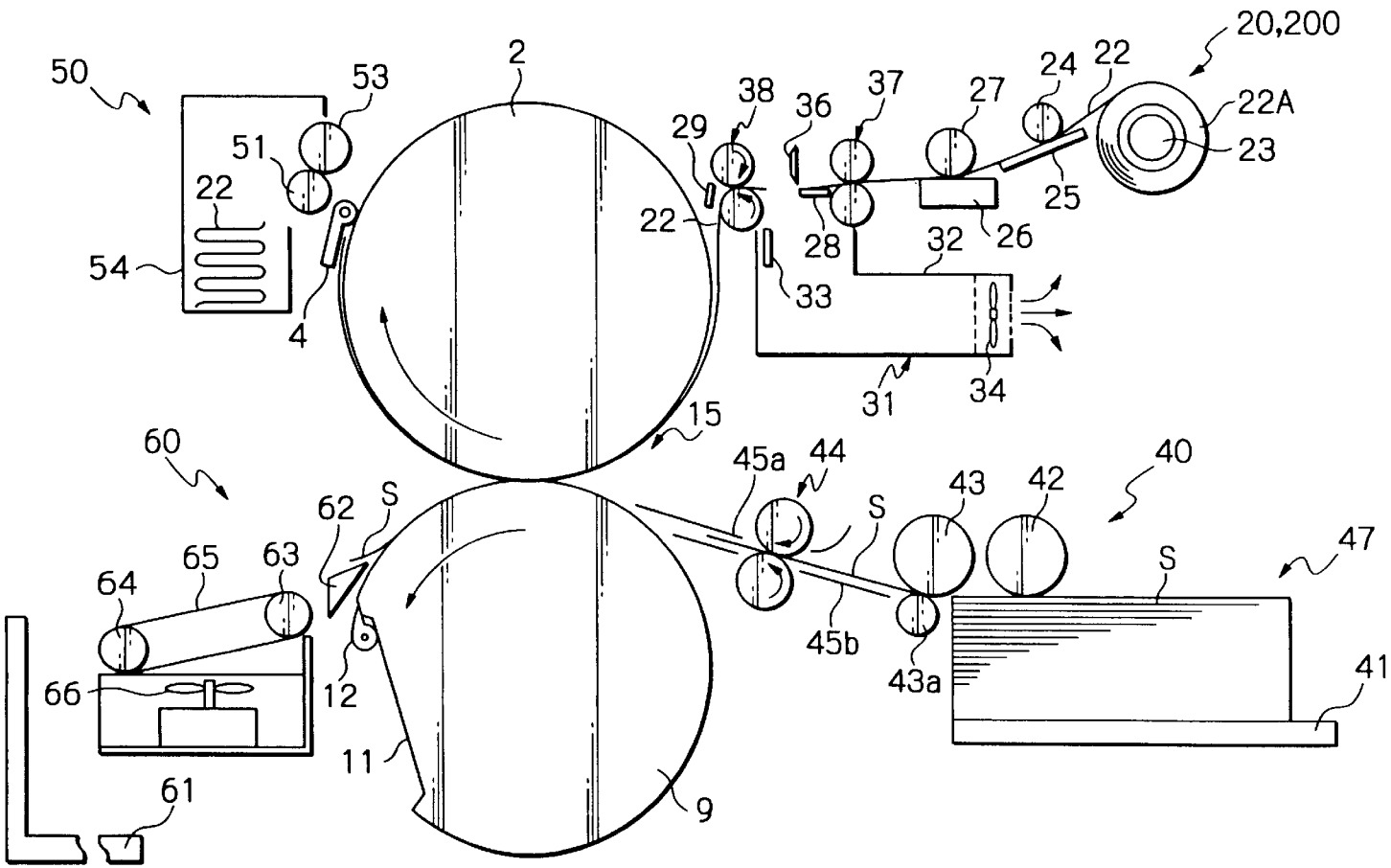
FIG. 20 is a fragmentary front view showing printing effected in parallel to the master feed and relating to the first specific procedure of the illustrative embodiment and the first conventional procedure.

As shown in FIGS. 19 and 20, the bend of the stencil 22 accommodated in the master stocking means 31 sequentially decreases. At time T21 when the bend is minimum, the cutter motor 36M is turned on and causes the cutter 36 to rotate and run in the widthwise direction of the stencil 22 along the edge of the first guide plate 28, thereby cutting the trailing edge of the perforated part of the stencil 22 to produce a master 22. Subsequently, the cutter 36 returns to its home position. When the cutter home position sensor 49 senses the cutter 36 returned to the home position, the cutter motor 36M is turned off to end the operation of the cutter 36 at time T23.

At time T21 when the plotter motor 27M is turned off and the cutter motor 26M is turned on, the print drum 2 reaches a position between positions shown in FIGS. 19 and 20. At this time, the clutch 38C is turned on. That is, before the print drum 2 reaches the position between the positions shown in FIGS. 19 and 20, the clutch 38C remains in an OFF state and causes back tension to lightly act on the stencil 22 between the turn roller pair 38 and the damper 4.

After the turn-on of the clutch 38C, the upper turn roller 38 is subjected to a load due to the turn-off of the plotter motor 27 and locked thereby. As a result, the lower turn roller 38 is rotated by the master 2 being conveyed due to the rotation of the print drum 2. In this condition, adequate back tension acts on the master 22 between the turn roller pair 38 and the damper 4 in the same manner as shown in, e.g., FIG. 1 and described in a paragraph (0077) of Laid-Open Publication No. 11-91227 mentioned earlier. More specifically, adequate tension, which sequentially increases from the center of the master 22 toward the opposite sides in the widthwise direction, acts obliquely on the stencil 22. This prevents the master 22 from being shifted and allows it to be sequentially wrapped around the drum 2 with the opposite sides thereof being stretched while admitting a minimum of air.

As the master 22 is sequentially wrapped around the print drum 2, a bend sensor, not shown, adjoining the opening 32*a* of the box 32 stops sensing the bend of the master 22 due to the disappearance of the bend, as shown in FIG. 20. When the print drum 2 reaches a position corresponding to time T22 at which the trailing edge of the master 22 is about to move away from the turn roller pair 38, the main control unit 500 turns off the clutch 38C in response to the output of the home position sensor 14 and that of the encoder. As a result, the upper turn roller 38, like the lower turn roller 38, becomes freely rotatable and reduces the tension acting on the master 22 between the turn roller 38 and the print drum 2. This eases the behavior of the master 22 when the trailing edge of the master 22 moves away from the turn roller pair 38. The master 22 is therefore free from creases or skew when it is being wrapped around the drum 2.

As shown in FIGS. 19 and 20, a paper feeding operation begins around time T23 in synchronism with the rotation of the print drum 2 to its home position. Specifically, the registration motor 44M is turned on and causes the registration roller pair 44 to convey the paper sheet S in synchronism with the rotation of the print drum 2. At the same time, the damper 12 of the press drum 9 is caused to open, clamp the paper sheet S, and then close. The press drum 9 is rotated while retaining the paper sheet S thereon and brings the paper sheet S to the nip between the press drum 9 and the print drum 2. At this time, the solenoid of the holding means included in the print drum drive 16 is turned on to enable the cam drive mechanism to move the press drum 9 into and out of contact with the print drum 2. After a printing operation, the above solenoid is turned off and causes the cam drive mechanism to release the press drum 9 from the print drum 2. A tension spring, not shown, included in the press drum moving means presses the nip between the print drum 2 and the press drum 9, so that the paper sheet S is pressed against the master 22 wrapped around the print drum 2. Consequently, the ink fed to the inner periphery of the print drum 2 by the ink roller 6 oozes out via the perforations of the master 22 and prints an image on the paper sheet S.

While the print drum 9 is in rotation, the damper 12 is opened at a position short of the peeler 62. The paper sheet or print S carrying the image thereon gets on the opened peeler 62 and is peeled off thereby. The paper sheet S is then transferred to the belt 65 through the operation of the paper discharge drive 67. The belt 65 conveys the paper sheet S to the tray 61 due to the rotation of the outlet roller 64 while the suction fan 66 retains the paper sheet S on the belt 65 by suction. This paper sheet S is a trial print and not counted as a regular print.

As shown in FIGS. 19 and 20, the master discharging section 50 continues the master discharging operation from time T19 to time T23 until the print drum 2 again reaches the master discharging position. When the print drum 2 is about to reach the master discharging position, the entire used master 22 is peeled off from the print drum 2. When the used master 22 is discarded into the box 54, the master discharge motor 52 is turned off to end the master discharging operation. At this time, the printing section 15 is performing the printing operation and paper discharging operation.

Around the time when the print drum 2 reaches the master feeding position, the new master 22 is fully wrapped around the print drum 2. At times T23 through T25, the paper sheet or trial print S is driven out to the tray 61. At time T28, the main motor 17 is turned off with the result that the print drum 2 reaches and stops at its home position.

The operator, watching the trial print S, checks the quality and position of the image and then presses the print key 92 if they are acceptable. In response, the master feeding operation, printing operation and paper discharging operation described above are repeated to produce a regular print.

On the other hand, at time T25, the registration roller pair 44 is caused to stop rotating. This is the end of the printing operation.

Figure 21:
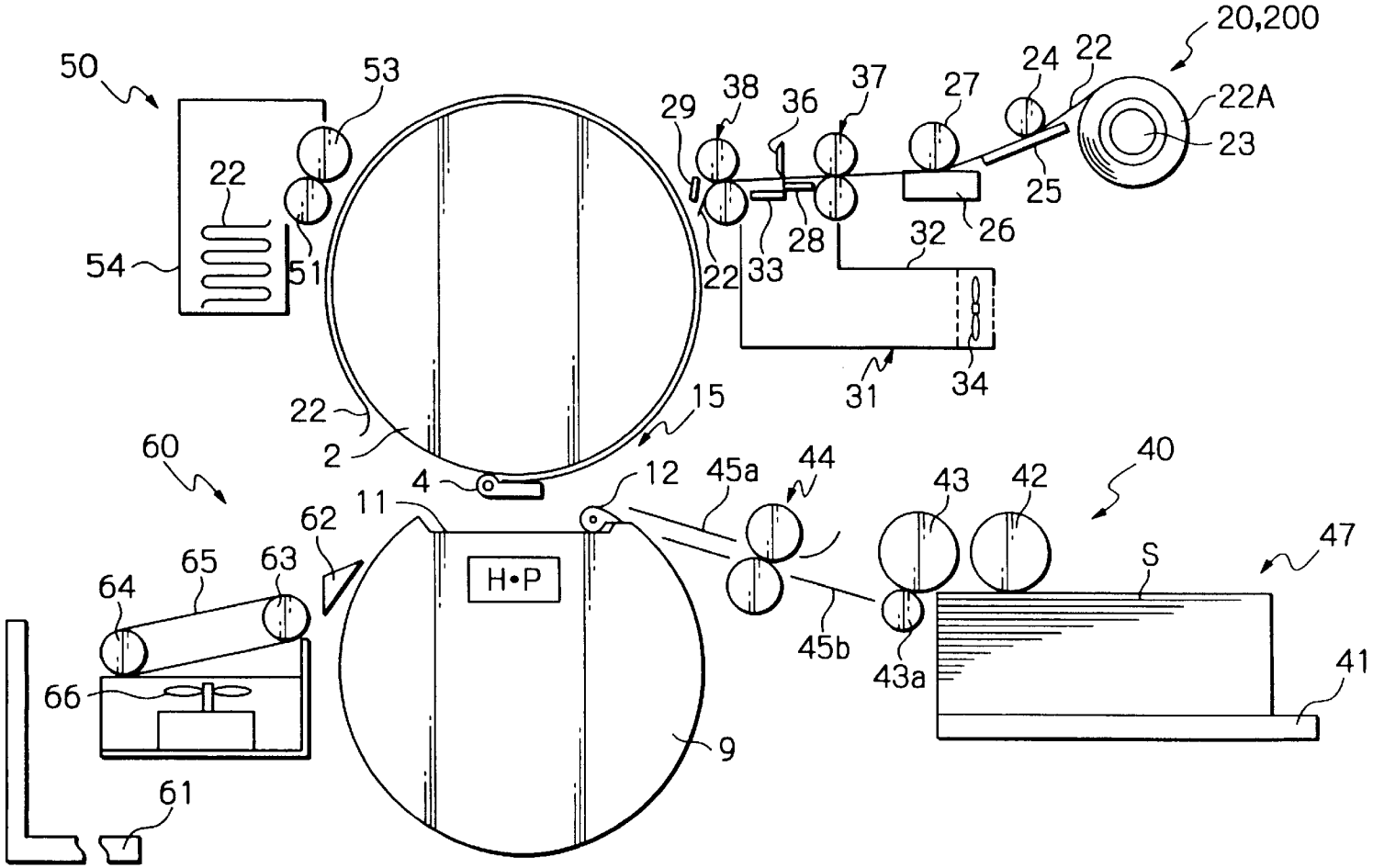
FIG. 21 is a fragmentary front view showing the print drum stopped at its home position after trial printing and relating to the first specific procedure of the illustrative embodiment and the first conventional procedure.

Also, at time T25, the guide/conveyor plate 33 included in the master making and feeding section 200 is angularly moved from the bending position to the guiding position. At the same time, the plotter motor 27M is turned on and causes the platen roller 27 and tension roller pair 37 to rotate. Further, the solenoid-operated clutch 38C is energized to rotate the turn roller pair 38. The tension roller pair 37 and turn roller pair 38 convey the leading edge of the stencil 22, which has been cut by the cutter 36, to the downstream side of the path MR. At this instant, the first guide plate 28, guide/conveyor plate 33 and second guide plate 29 guide the stencil 22. At time T26, the main control unit 500 determines, based on the number of steps of the plotter motor 27M, that the leading edge of the stencil 22 has reached the stand-by position. The main control unit 500 then turns off the platen motor 27M and clutch 38C in order to stop the rotation of the platen roller 27, tension roller pair 37 and turn roller pair 38, as shown in FIG. 21.

The platen pressure cancel motor 134 is rotated in order to cancel the platen pressure and then brought to a stop when the platen pressure cancel sensor 135 turns (times T26 and T27).

Figure 22:
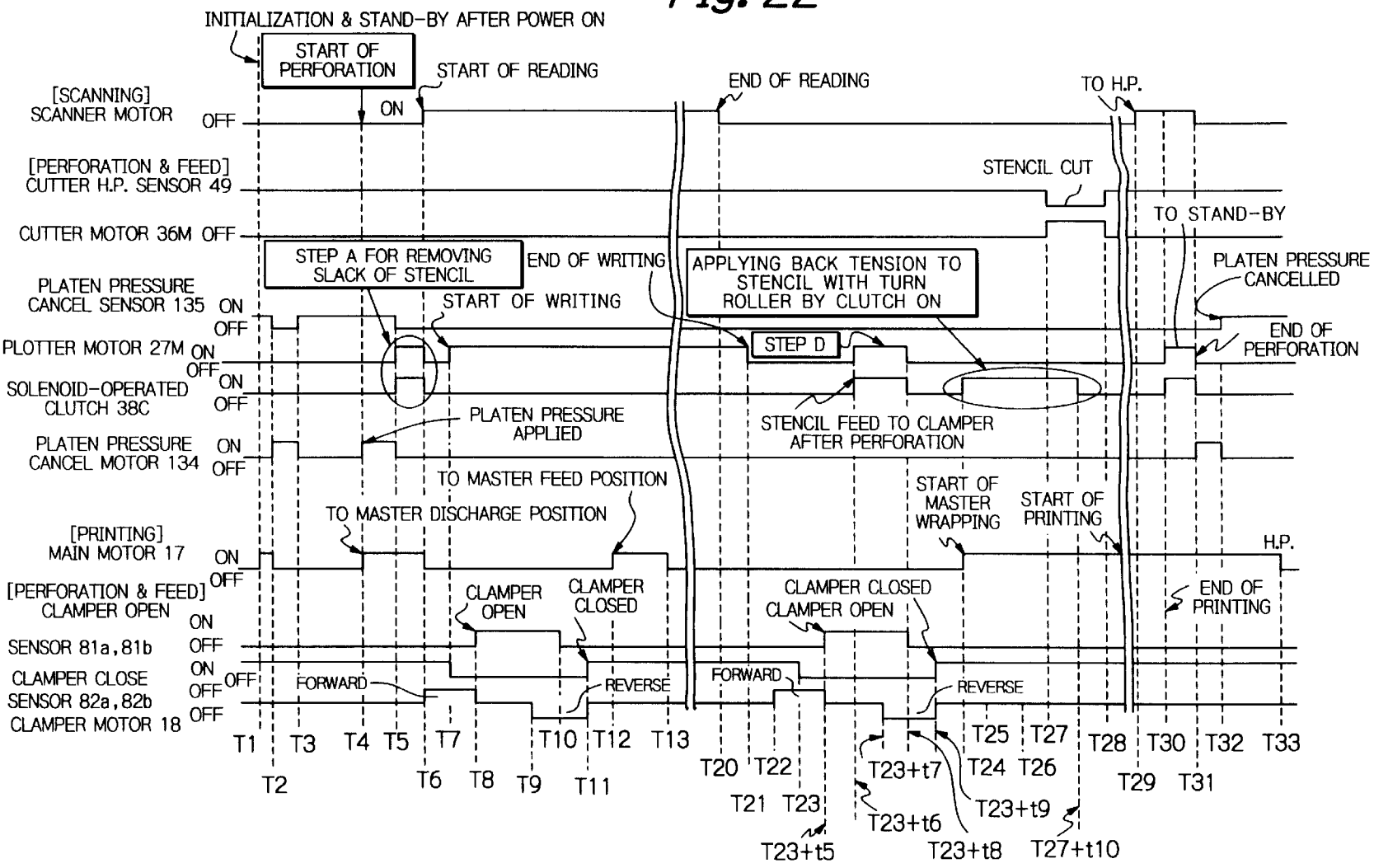
FIG. 22 is a timing chart demonstrating a second conventional specific procedure.

A second conventional specific procedure will be described hereinafter with reference to FIG. 22. The second conventional procedure differs from the first conventional procedure only in that it proceeds in accordance with the timing chart of FIG. 22. The first procedure has a problem that a step B shown in FIG. 12 causes the pitch of perforations formed in the master 22 to slightly decrease. This problem will be described more specifically later as a problem (1). The second procedure is a solution to this problem.

In the first procedure, the solenoid-operated clutch 38C turns on at time T15 and then turns off at time T16 when the master making section is under way in the first conveying section 201-1. In the second procedure, the plotter motor 27M of the first conveying section 201-1 and the clutch 38C of the second conveying section 201-2 both are turned on at time T23+t6 and then turned off at time T23+t8 after the time T21 at which the master making operation ends.

More specifically, after the master making (writing) operation (time T21), the second procedure causes the entire perforated part of the stencil 22 to be accommodated in the box 32 and then executes the step of introducing the leading edge of the stencil 22 into the opened damper 4. Consequently, the operations of the drive sections joining in the above step are sequentially shifted in the direction in which time T increases. For example, after the stop of the print drum 2 at the master feeding position, the first procedure causes the damper motor 18 to rotate in the forward direction for a preselected period of time in order to open the damper 4 (ON at time T13 and OFF at time T15). By contrast, the second procedure turns on the damper motor 18 at time T22 and turns it off at time T23+t5. In the first procedure, the clamper open sensor 81*b* responsive to the opening of the damper 4 turns on at time T15 and then turns off at time T17. In the second procedure, the sensor 81*b* turns on at time T23+t5 and then turns off at time T23+t8.

In the first procedure, after the damper 4 has been opened, the damper motor 18 is turned off from the time T15 to time T16, maintaining the print drum 2 in the stand-by sate. In the second procedure, the damper motor 18 is turned on from time T23+t5 to time T23+t7.

In the first operation, the leading edge of the stencil 22 is determined to have reached the damper 4 at time T16 on the basis of the number of steps of the plotter motor 27M. Also, the clutch 38 is turned off to stop the rotation of the turn roller pair 38. At the same time, the damper motor 18 is turned on to close the damper 4 and caused to rotate in the reverse direction up to time T18. In the second procedure, the damper motor 18 is turned on at time T23+t7 and then turned off at time T23+t9.

In the first procedure, the damper close sensor 82*b* responsive to the closing of the clamper 4 turns on at time T18 and remains in an ON state even after time T28. In the second procedure, the sensor 82*b* turns on at time T23+t9 and remains in an ON state even after time T33.

In the first procedure, after the main motor 17 has been turned on at time T19 for wrapping the stencil 22 around the print drum 2, the clutch 38 is turned on at time T21 for causing the turn roller 38 to exert back tension on the stencil 22 and remains in an ON state up to time T22. In the second procedure, the main motor 17 is turned on at time T24, and then the clutch 38C is energized at time T24 and remains in an ON state up to time T27+t10. Further, in the second procedure, the steps to be executed in the stand-by state assigned to printing and at the end of the printing operation are shifted, as shown in FIG. 22. The main motor 17 is turned off, in the first procedure, at time T28 for stopping the print drum 2 at the home position, but it is turned off at time T33 in the second procedure.

In the first procedure, the scanner motor of the document reading section 70 is turned on at time T24 and then turned off at time T26 to return to the home position. In the second procedure, the scanner motor is turned on at time T29 and then turned off at time T31.

In the first procedure, the cutter motor 36M is turned on at time T21 at which the bend of the stencil 22 becomes minimum, and then turned off at time T23 at which the cutter home position sensor 49 senses the cutter 36 returned to its home position after the cutting movement. In the second procedure, the cutter motor 36M is turned on at time T27 and then turned off at time T28.

In the first procedure, the plotter motor 27M and clutch 380 are turned on at time T25 for conveying the leading edge of the stencil 22 and then turned off at time T26 at which the leading edge reaches the stand-by position assigned to perforation. In the second procedure, the plotter motor 27M and clutch 38C are turned on at time T30 and then turned off at time T31.

In the first procedure, after the platen pressure cancel motor 134 has been turned on at time T26 for canceling the platen pressure, it is turned off at time T27 at which the platen pressure cancel sensor 135 turns on. In the second procedure, the motor 134 is turned on at time T31 and then turned off at time T32.

The stencil printer 1,000 described above has the following problems (1) through (6) left unsolved.

(1) When the clutch 38C is turned on during perforation in order to rotate the upper turn roller 38 (step B, FIG. 12), the drive load acting on the turn roller pair 38C sharply increases. Such a sharp change in load makes the rotation of the plotter motor (stepping motor) 27M, which is rotating the platen roller 27, irregular. As a result, the pitch of perforations formed in the stencil 22 slightly decreases. To solve this problem, in a step D shown in FIG. 22, the plotter motor 27M and clutch 38C are turned on at the same time after the plotter motor 27M has been turned on at time T23+t6 and then turned off at time T23+t8. As a result, the turn roller pair 38 is rotated to convey the stencil 22 toward the print drum 2. This alternative scheme, however, increases the waiting time up to the end of the master discharging operation (time T31, FIG. 22) and therefore FPT.

(2) When the platen pressure canceling mechanism 128 is available, it cancels the pressure of the platen roller 27 and that of the tension roller pair 37 in the stand-by state assigned to perforation. As a result, the stencil 22 slackens between the stencil set roller 24 and the turn roller pair 38. Should the slackened stencil 22 be wrapped around the print drum 2 and used to produce prints, it would crease or would make the perforation start position unstable. In light of this, the clutch 38C and plotter motor 27M are turned on at the same time in order to convey the stencil 22 by a short distance of about 5 mm to about 8 mm, as represented by a step A in FIG. 12. The stencil 22 is therefore perforated after its slack has been removed. This, however, must allocate a period of time of 0.2 second to 0.5 second to the simple step A of removing the slack of the master 22.

(3) The stencil 22 is fed after the step A described in relation to the problem (1). The clutch 38C therefore cannot be turned on and maintains the turn roller pair 38 freely rotatable. As a result, the leading edge of the stencil 22 is dislocated due to, e.g., vibration.

(4) To wrap the perforated stencil 22 around the print drum 2, the clutch 38C is energized to prevent the upper turn roller 38 from freely rotating. The upper turn roller 38 exerts a load on the stencil 22 and thereby prevents it from creasing (step C, FIG. 12). This, however, cannot be done before the plotter motor or stepping motor 27M for driving the platen roller 27, as well as other rollers, is turned off. As a result, the waiting time up to the end of the master making operation and therefore FPT increases, as in the problem (1).

(5) Assume that turn rollers included in a second conveying section (second conveyor roller 20 and third conveyor roller 24 in Laid-Open Publication No. 11-20295) are driven by a stepping motor or similar motor. Then, the perforated stencil 22 is conveyed toward the damper 4 at a lower speed than the platen roller 27 conveys the stencil 22 (peripheral speed). This also increases FPT because the conveying speed of the second conveying section is lower than the conveying speed of a first conveying section.

(6) To drive the turn rollers of the second conveying section, use is made of a stepping motor in order to prevent the turn rollers from rotating due to vibration in the stand-by state and prevent the stencil 22 from being dislocated. As a result, current is fed even when the stepping motor is not actually driven, resulting in the waste of electric energy.

A preferred embodiment of the master making and feeding device in accordance with the present invention will be described hereinafter. Identical structural elements included in the above-described conventional construction and illustrative embodiment are designated by identical reference numerals and will not be described specifically in order to avoid redundancy. As for structural elements provided in pairs and not needing distinction, only one of them will be described for the simplicity of description.

FIG. 1 shows a stencil printer 1 to which the illustrative embodiment is applied. As shown, the printer 1 includes a master making and feeding section or device 20 in place of the conventional master making and feeding section 200. As shown in FIG. 3, the printer 1 includes an operation panel 90 in place of the conventional operation panel 900. Further, the printer 1 includes a main control unit 120 in place of the conventional main control unit 500.

In the conventional construction, the first and second conveying sections 201-1 and 201-2 share a single plotter motor 27M while the second conveying section 201-2 includes the solenoid-operated clutch 38C, as described with reference to FIG. 10. In the illustrative embodiment, as shown in FIGS. 1 and 2, a first conveying section 21-1 includes a plotter motor or first drive source 100 shared by the stencil set roller 24, platen roller 27 and tension roller pair 37. A second conveying section 21-2 includes a stepping motor or second drive source 110 that is a specific form of a motor driven by pulses.

A timing belt 102 is passed over a double platen pulley 103 affixed to the shaft of the platen roller 27 and a drive pulley 101 affixed to the output shaft of the plotter motor 100. The plotter motor 100 drives the platen roller 27 via the timing belt 102. A timing belt 104 is passed over a tension pulley 105 affixed to the shaft of the upper tension roller 37 and the platen pulley 103. The plotter motor 100 drives the upper tension roller 37 via the timing belts 104 and 102. The plotter motor 100 is implemented by a stepping motor.

A timing belt 112 is passed over a turn roller pulley 113 affixed to the shaft of the upper turn roller 38 and a drive pulley 111 mounted on the output shaft of the stepping motor 110. The stepping motor 110 drives the upper turn roller 38 via the timing belt 112.

As shown in FIG. 3, the operation panel 90 includes the previously mentioned energy save mode key or mode selecting means 95 used to determine whether or not to cancel the excitation of the stepping motor 110 or reduce current to be fed to the motor 110. When the operator presses the energy save mode key 95, an energy save mode signal is generated to set up an energy save mode for reducing wasteful energy consumption. This mode may be selected when, e.g., strict control over the image position of a master is not necessary.

During or after the application of the platen pressure, but before perforation, the stepping motor 110 is driven for a preselected period of time in order to remove the slack of the stencil 22 and insure the perforation start position. If this cannot be done, the energy save mode key 95 should preferably not be pressed. In this cases, in the stand-by state assigned to perforation, the stepping motor of the second conveying section 21-2 is excited so as to protect the stencil 22 from dislocation and insure the perforation start position, as will be described specifically later.

Figure 4:
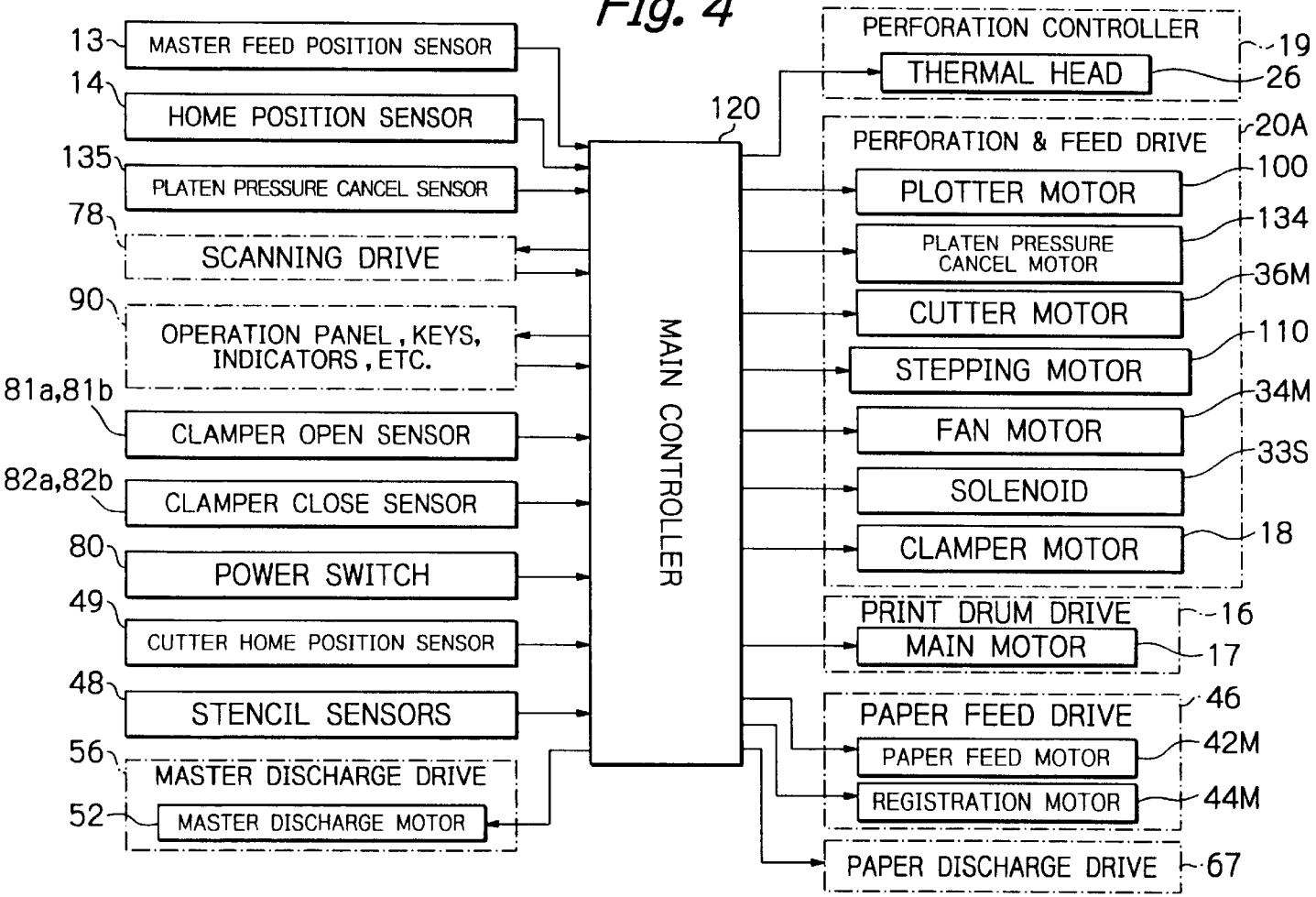
FIG. 4 is a block diagram schematically showing a control system included in the stencil printer.

A control system unique to the illustrative embodiment will be described with reference to FIG. 4. As shown, the main control unit 120, like the main control unit 500, is implemented by a microcomputer. The main control unit 120 differs from the main control unit 500 mainly in that it controls various drive means included in a perforation and feed drive 20A in accordance with timing charts that will be described later. The perforation and feed drive 20A differs from the perforation and feed drive 200A in that the plotter motor 100 and stepping motor 110 are substituted for the plotter motor 27M and solenoid-operated clutch 38C, respectively. The plotter motor 100 does not drive the turn roller pair 38 and is therefore smaller in size than the conventional plotter motor 27M.

The main control unit 120 includes a CPU having various control functions that will be described specifically later, a ROM, and a RAM. The ROM stores programs and data necessary for the printer 1 to operate. The programs and data may be set in the ROM by writing data beforehand or by replacing a ROM chip. The RAM temporarily stores interim results of calculations output form the CPU as well as ON/OFF signals and data signals received from various sensors and keys.

At a preselected timing during or after perforation effected by the first conveying section 21-1, the main control unit 120 drives the stepping motor 110 of the second conveying section 21-2 in order to feed the leading edge of the perforated stencil 22 to the print drum 2. When driving the second conveying section 21-2, the main control unit 120 drives the stepping motor 110 such that the stencil conveying speed of the second conveying section 21-2 is constantly higher than the conveying speed of the first conveying section 21-2. In this sense, the main control unit 120 and a control circuit, not shown, and a motor driver, not shown, assigned to the stepping motor 110 and connected to the main control unit 120 constitute conveyance, drive means.

The main control unit 120 variably controls the frequency of pulses (pulse per second or pps) to be fed to the plotter motor 100 in order to vary the stencil conveying speed v1 of the first conveying section 21-1. Also, the main control unit 120 variably controls the frequency of pulses to be fed to the stepping motor 110 in order to vary the stencil conveying speed v2 of the second conveying section 21-2.

The thermal head 26 is brought into contact with the platen roller 27 in order to exert the platen pressure due to the ON/OFF operation of the platen pressure cancel motor 134. During or after the exertion of the platen pressure, but just before master making, the main control unit 120 drives the stepping motor 110 for a preselected period of time in response to the output signal of the platen pressure cancel sensor 135.

The main control unit 120 controls the motor driver assigned to the stepping motor 110 via the control circuit such that after the drive of the motor 110 effected in response to the output signal of the sensor 135, as stated above, the motor 110 is continuously excited up to the time of the next excitation of the motor 110. The motor driver is a power amplifying circuit including a motor exciting circuit. It is to be noted that the excitation of the stepping motor 110 refers to a condition wherein only exciting current is fed to excite the coil of the motor 110, i.e., no pulses are fed to the motor 110. In this condition, the stepping motor 110 is held stationary without being rotated.

Assume that the head 26 is spaced from the platen roller 27 due to the ON/OFF operation of the platen pressure cancel motor 134 (stand-by state assigned to perforation). Then, the main control unit 120 controls the control circuit and motor driver assigned to the stepping motor such that the excitation of the motor 110 is turned off or the exciting current to be fed thereto is reduced until the next drive of the stepping motor 110. It is to be noted that the reduction of the exciting current refers to a condition wherein the exciting current for exciting the coil of the motor 110 is reduced (current saving). In this condition, the force that holds the motor 110 is weakened. This is successful to save power, compared to the excitation of the motor 110.

In response to the energy save mode signal output from the energy save mode key 95, the main control unit 120 controls the control circuit and motor driver such that the excitation of the stepping motor 110 is turned off or the current supply to the motor 110 is reduced in the previously stated stand-by state assigned to perforation.

Further, the main control unit 120 controls the control circuit and motor driver such that when the perforated stencil 22 is wrapped around the print drum 2, the excitation ON/OFF timing of the stepping motor 110 is varied.

Figure 5:
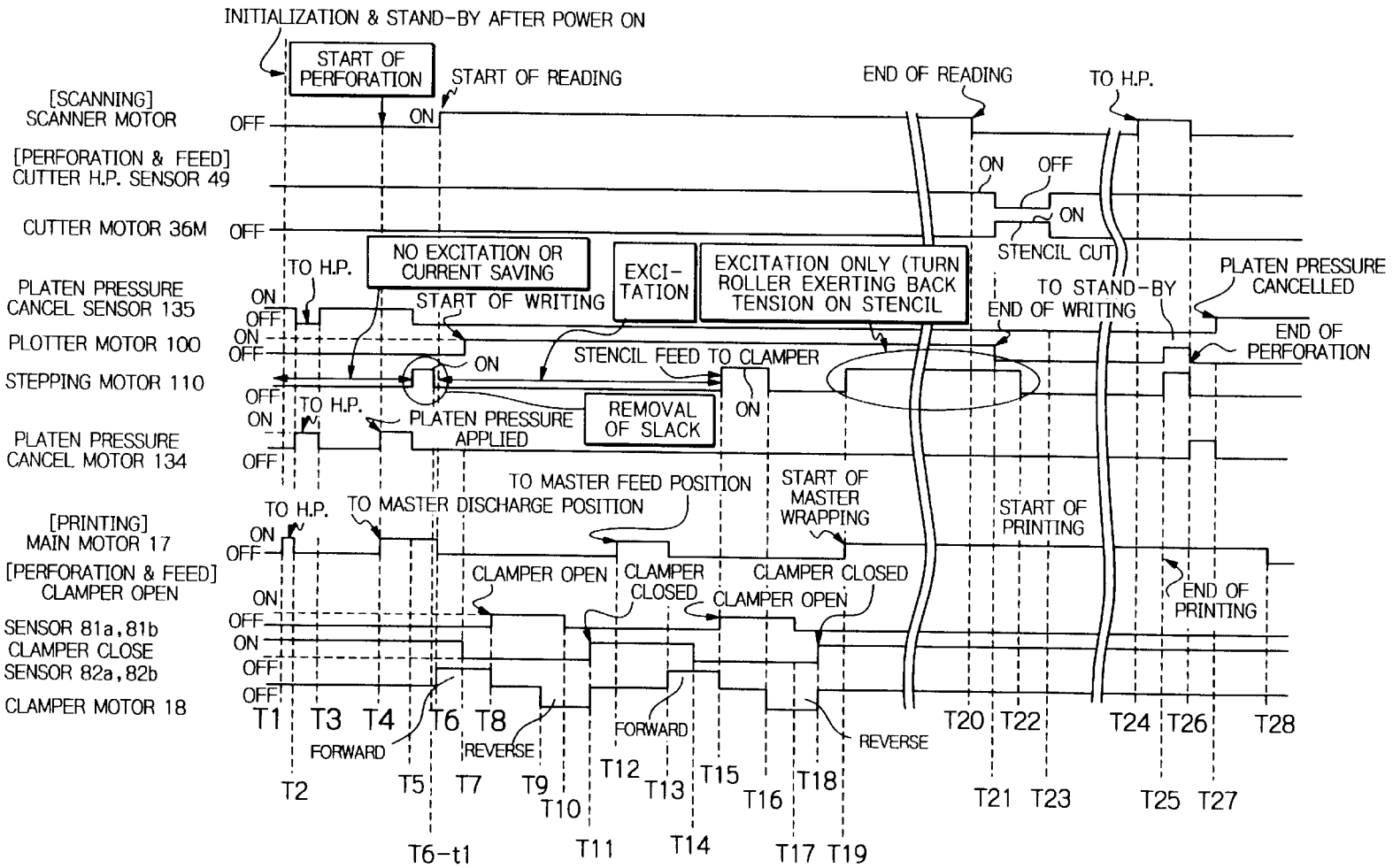
FIG. 5 is a timing chart representative of a first specific procedure unique to the illustrative embodiment.
Figure 6:
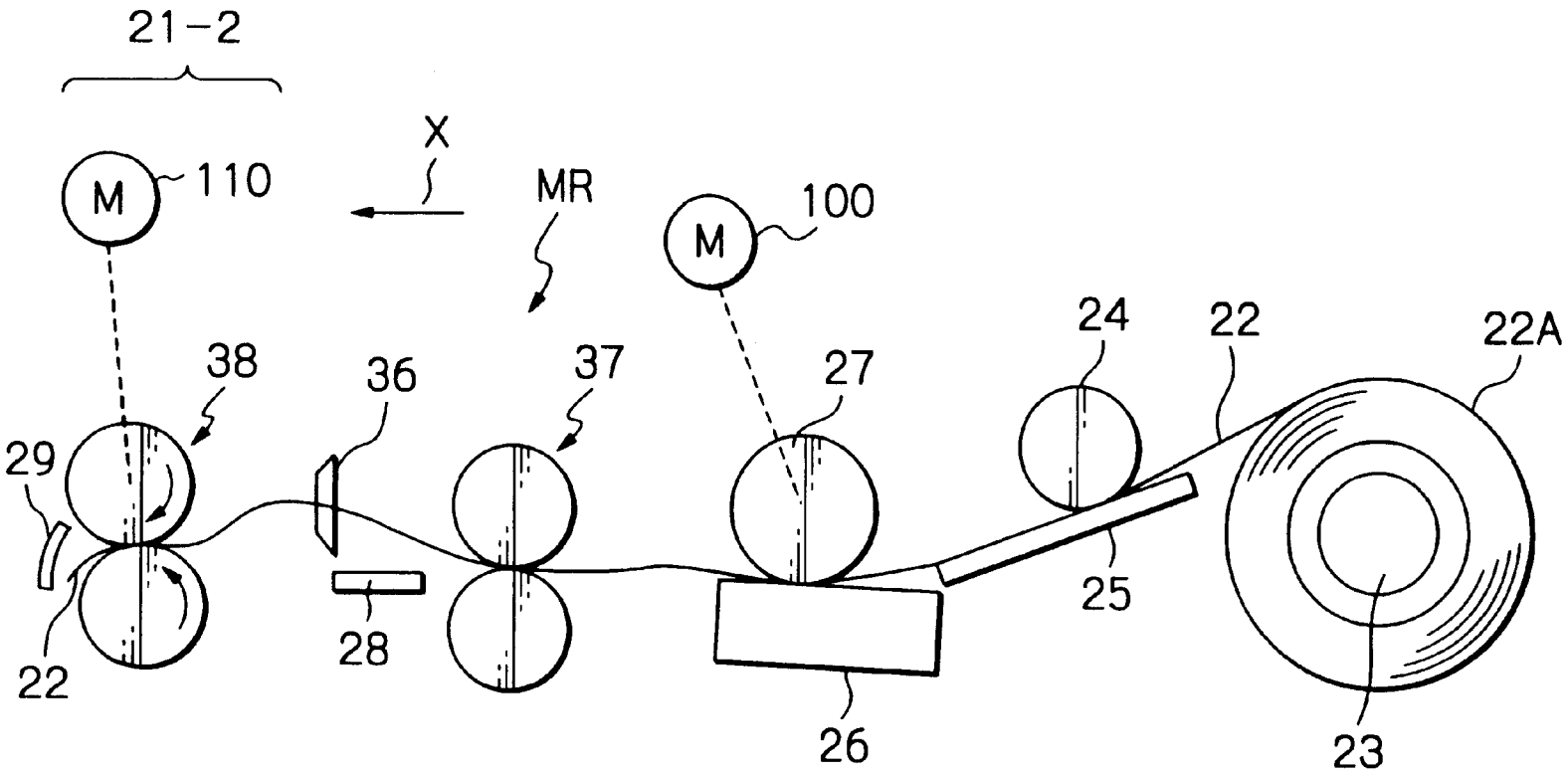
FIG. 6 is a fragmentary front view demonstrating how the first specific procedure removes the slack of a stencil in a stand-by state before perforation.

A first specific procedure of the illustrative embodiment will be described with reference to FIG. 5. The first specific procedure differs from the first conventional specific procedure (FIG. 12) mainly in the operation timings of the plotter motor 100 and stepping motor 110, which are substitutes for the plotter motor 27M and clutch 28C. As for common operation steps, the first specific procedure of the illustrative embodiment is easily practicable when the main control unit 500 and plotter motor 27M shown in FIG. 12 are interpreted as the main control unit 120 and plotter motor 100, respectively. The following description will therefore concentrate on differences between FIGS. 5 and 12. The first specific procedure, as well as a second to a fourth specific procedure to be described later, also executes the high-speed mode 1 in which the print drum 2 makes two rotations between the generation of the perforation start signal (time T4) and the return of the drum 2 to the home position after the output of a trial printing.

In the first specific procedure, the operator turns on the power switch 80 and then determines whether or not to select the energy saving mode in which the excitation of the stepping motor 110 is turned off or current supply thereto is reduced. Assume that the operator presses the energy save mode key 95 in order to input the energy saving mode. Then, the main control unit 120 turns off the excitation of the stepping motor 110 or reduces exciting current to be fed to the motor 110 in the stand-by state assigned to perforation, i.e., from time T1 to time T5. In FIG. 5, this condition is represented by "No Excitation or Current Saving".

When a stepping motor, for example, is used to drive the turn roller pair 38, it is necessary to excite, in the stand-by state assigned to perforation, the motor in order to prevent it from rotating due to vibration and dislocating the stencil 22. This, however, causes current to flow even when the stepping motor is not actually driven, and wastes electric energy. By contrast, when strict control over image position is not necessary, the first specific procedure allows the operator to determine whether or not to select the energy saving motor on the key 95.

When the head 26 is held in contact with the platen roller 27 for exerting the platen pressure due to the ON/OFF of the platen pressure cancel motor 134 or after such an operation, but just before master making, the stepping motor 110 is driven for a preselected period of time in order to remove the slack of the stencil 22 and thereby insure the accurate perforation start position. In the case of a stencil printer unable to perform such an operation, the energy save mode key 95 is not pressed. Instead, in the stand-by state assigned to perforation, the stepping motor 110 is excited to prevent the turn roller from rotating due to, e.g., vibration and dislocating the stencil 22. This successfully maintains the perforation start position of the stencil 22.

In the first specific procedure, at time T5 when the platen pressure is exerted, the plotter motor 100 is not driven, but only the stepping motor 110 is driven for a preselected period of time (from time T5 to time T6–t1). As a result, only the upper turn roller 38 is rotated in order to remove the slack of the stencil 22, as shown in FIG. 2. At this instant, the stencil 22 between the stencil set roller 24 and the guide 25, between the platen roller 27 and the head 26 and between the tension rollers 37 is conveyed to the downstream side of the path X while causing the rollers to rotate and slipping on them. Because only the stepping motor 110 drives the turn roller pair 38, the drive time is shorter than the drive time of the step A, FIG. 12, by about 0.2 second to 0.5 second (t1), and reduces FPT accordingly. In addition, it is possible to prevent the stencil 22 from creasing and to stabilize the perforation start position, as stated earlier.

In the first specific procedure, after only the stepping motor 110 has been driven for the preselected period of time (from time T5 to time T6–t1), the motor 110 is excited until the next drive thereof (from time T6–t1 to time T15). Specifically, in the conventional construction, the plotter motor 27M is turned on after the step A, FIG. 12, due to the start of writing. The clutch 380 therefore cannot be coupled; should the clutch 38C be coupled, it would cause the stencil 22 to be fed. By contrast, the first specific procedure excites the stepping motor 110 for a preselected period of time (from time T5 to time T6–t1) at a preselected timing, rendering the turn roller pair 38 freely rotatable. This prevents the stencil 22 located at the perforation start position from being shifted.

After the print drum 2 has been stopped at the master feeding position, the first specific procedure introduces the leading edge of the stencil 22 into the clamper 4 in a unique way. At this instant, the plotter motor 100 has been turned on. The stepping motor 110 is turned on at time T15 and then turned off at time T16 during perforation in order to introduce the leading edge of the stencil 22 into the camper 4. At the same time, the stepping motor 110 is controlled such that the second conveying section 21-2 conveys the stencil 22 at the speed v2 higher than the conveying speed v1 of the first conveying section 21-1.

Specifically, the conveying speed v2 of the second conveying section 21-2, i.e., the peripheral speed of the turn roller pair 38 is 22 mm/sec. The conveying speed V1 of the first conveying section 21-1, i.e., the peripheral speed of the stencil set roller 24, platen roller 27 and tension roller pair 37 is 20 mm/sec. More specifically, the main control unit 120 varies the frequencies of pulses to be fed to the stepping motor 110 and plotter motor 100 to thereby set up a relation of v2>v1. To be exact, as for the conveying speed v1, the peripheral speed of the tension roller pair 37 is slightly higher than the peripheral speed of the platen roller 27 that is, in turn, slightly higher than the peripheral speed of the stencil set roller 24. This relation is similar to the scheme described in, e.g., paragraphs (0164) to (0165) of Laid-Open Publication No. 9-226088 mentioned earlier.

In the first specific procedure, the stepping motor 110 is turned on at time T15 and then turned off at time T16 when the leading edge of the stencil 22 is to be introduced into the damper 4, as stated earlier. In the step B, FIG. 12, the rotation of the plotter motor 27M becomes irregular due to the drive load of the turn roller pair 38 ascribable to the turn-on of the clutch 38C. The first specific procedure therefore prevents the pitch of perforations formed in the stencil 22 from slightly decreasing. Further, in the second conventional procedure shown in FIG. 22, the plotter motor or stepping motor 27M and clutch 380 are turned on at the same time during conveyance effected outside of the master making area after the writing or master making operation (time T21), conveying the stencil 22 toward the print drum 2. The first specific procedure of the illustrative embodiment does not include such a step and reduces the waiting time up to the end of the master making operation (time T31) and therefore FPT.

In the first specific procedure, when the perforated stencil 22 is wrapped around the print drum 22, the excitation of the stepping motor 110 is turned on and then turned off at a different timing. Specifically, the stepping motor 110 is excited at the same time as the main motor 17 is turned at time T19 for starting wrapping the stencil 22 (from time T19 to time T23). This prevents the upper turn roller 38 from freely rotating and exerts a load on the stencil 22 to be wrapped around the print drum 2 for thereby protecting the stencil 22 from creases.

More specifically, after the excitation of the stepping motor 110, the upper turn roller 38 is locked due to the resulting load while the lower turn roller 38 is rotated by the stencil 2 being conveyed due to the rotation of the print drum 2. In this condition, adequate back tension acts on the stencil 22 between the turn roller pair 38 and the camper 4, as shown in, e.g., FIG. 1 and described in paragraph (0077) of Laid-Open Publication No. 22-91227 mentioned earlier. Consequently, adequate tension, which sequentially increases from the center toward the opposite sides of the stencil 22, acts on the stencil 22 obliquely in the direction of stencil conveyance X. The stencil 22 can therefore be sequentially wrapped around the drum 2 without being dislocated and with its opposite sides being stretched. In addition, a minimum of air is admitted via the opposite sides of the stencil 22.

The step C, FIG. 12 (from time T21 to time T22), cannot be effected before the plotter motor or stepping motor 27M is turned off, because the clutch 38C is turned on in order to drive the upper turn roller 38. By contrast, the first specific procedure of the illustrative embodiment effects the unique operation by varying the timing, as stated earlier.

As for the first specific procedure, the stepping motor 110 is a specific form of a motor driven by pulses independent of pulses input to the plotter motor 100. The conveying speeds v1 and v2 of the first and second conveying sections 21-1 and 21-2, respectively, both are variably control led when, e.g., the stencil 22 is set or when it is fed. Specifically, the main control unit 120 controls the frequency of pulses to be fed to the plotter motor 100 in order to vary the conveying speed v1 of the first conveying section 21-1 and controls the frequency of pulses to be fed to the stepping motor 110 in order to vary the conveying speed v2 of the second conveying section 21-2. For example, the conveying speed v1 of the platen roller 27 and the conveying speed v2 of the upper turn roller 38 are respectively 15 mm/sec and 22 mm/sec when the stencil 22 is set or 20 mm/sec and 38 mm/sec when the stencil 22 is fed toward the damper 4.

Again, the stepping motor 110 is driven such that the conveying speed v2 (peripheral speed of the platen roller 27) is higher than the conveying speed v1 (peripheral speed of the upper turn roller 38). In addition, when the stencil 22 is set, it is conveyed relatively slowly because the leading edge of the stencil 22 paid out from the roll 22A for the first time is apt to crease and because the roll 22A has high inertial resistance. On the other hand, when the stencil 22 is fed toward the damper 4, it is conveyed relatively rapidly because the probability of the above problems is relatively low. In this manner, the conveying speeds v1 and v2 are varied to protect the stencil 22 from slackening or creasing.

Figure 7:
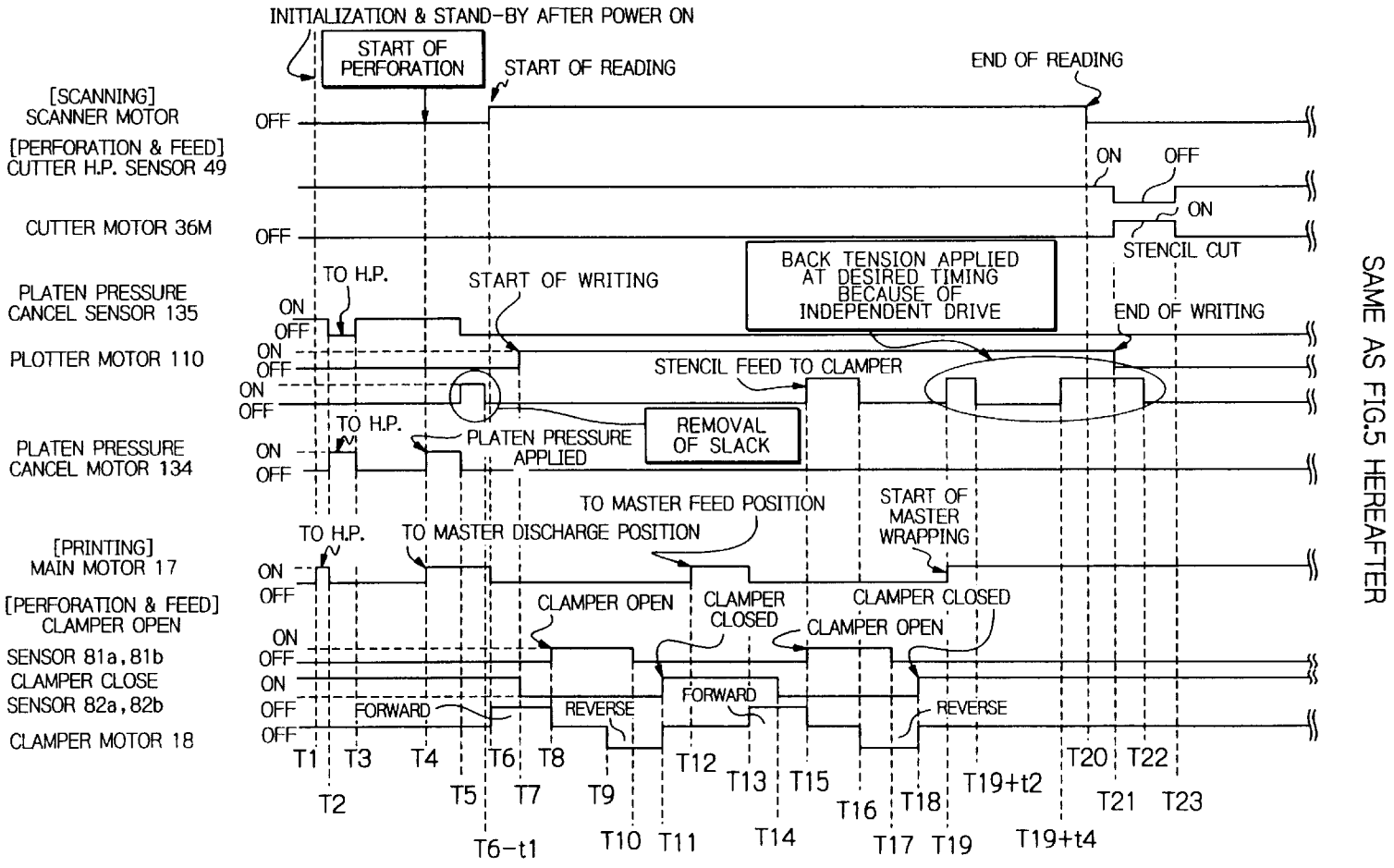
FIGS. 7, 8 and 9 are timing charts respectively showing a second, a third and a fourth specific procedure also available with the illustrative embodiment.

Reference will be made to FIG. 7 for describing a second specific procedure available with the illustrative embodiment. The second specific procedure differs from the first specific procedure mainly in the status and operation timing of the stepping motor 110. The following description will concentrate on differences between the first and second specific procedures.

In the second procedure, assume that the operator does not press the energy save mode key 95 because the operator does not des ire the energy saving mode or because the energy saving mode is not necessary. Then, from time T1 when the power switch is turned on to time T5 when the stand-by state assigned to perforation is set up, the stepping motor 110 is continuously excited in order to protect the stencil 22 from dislocation. This guarantees the perforation start position of the stencil 22. Further, when the operator does not desire the energy saving mode and when the master perforation start position does not have to be guaranteed, the energy save mode key 95 may be omitted from the illustrative embodiment, in which case no commands will be sent to the stepping motor 110.

Assume that some shift of the stencil 22 from the perforation start position, which may occur due to oscillation when the turn roller pair 38 becomes free to rotate, is acceptable. Then, after driving only the stepping motor 110 for the preselected period of time (from time T5 to time T6−t1), the second procedure does not excite the motor 110 up to the next drive of the motor 110 (from time T6−t1 to time T15).

Assume that use may be made of a stencil 22 having different stiffness or rigidity, e.g., a stencil whose porous support is comparatively thin, and/or the stiffness of the stencil 22 varies due to the varying ambient conditions including temperature and humidity. Then, when the perforated stencil 22 is wrapped around the print drum 2, the ON/OFF timing of the stepping motor 110 is varied in accordance with the kind of the stencil 22 and/or the ambient conditions. Specifically, at the same as the main motor 17 is turned on to start wrapping the stencil 22 around the print drum 2 at time T19, the stepping motor 110 is excited for a preselected period of time up to time T19+t2. Subsequently, the stepping motor 110 is again excited at time T19+t4 before the end of the scanning operation, and continuously excited up to time T22. Using such an excitation pattern, the second procedure achieves the same advantages as the first procedure without regard to the kind of the master 22 or the ambient conditions.

In the second procedure, the main control unit 120 varies the ON/OFF timing of the stepping motor 110, as stated above, in accordance with the output of a kind-of-master sensor or sensing means, a temperature sensor or sensing means, or a humidity sensor or sensing means, although not shown specifically.

Figure 8:
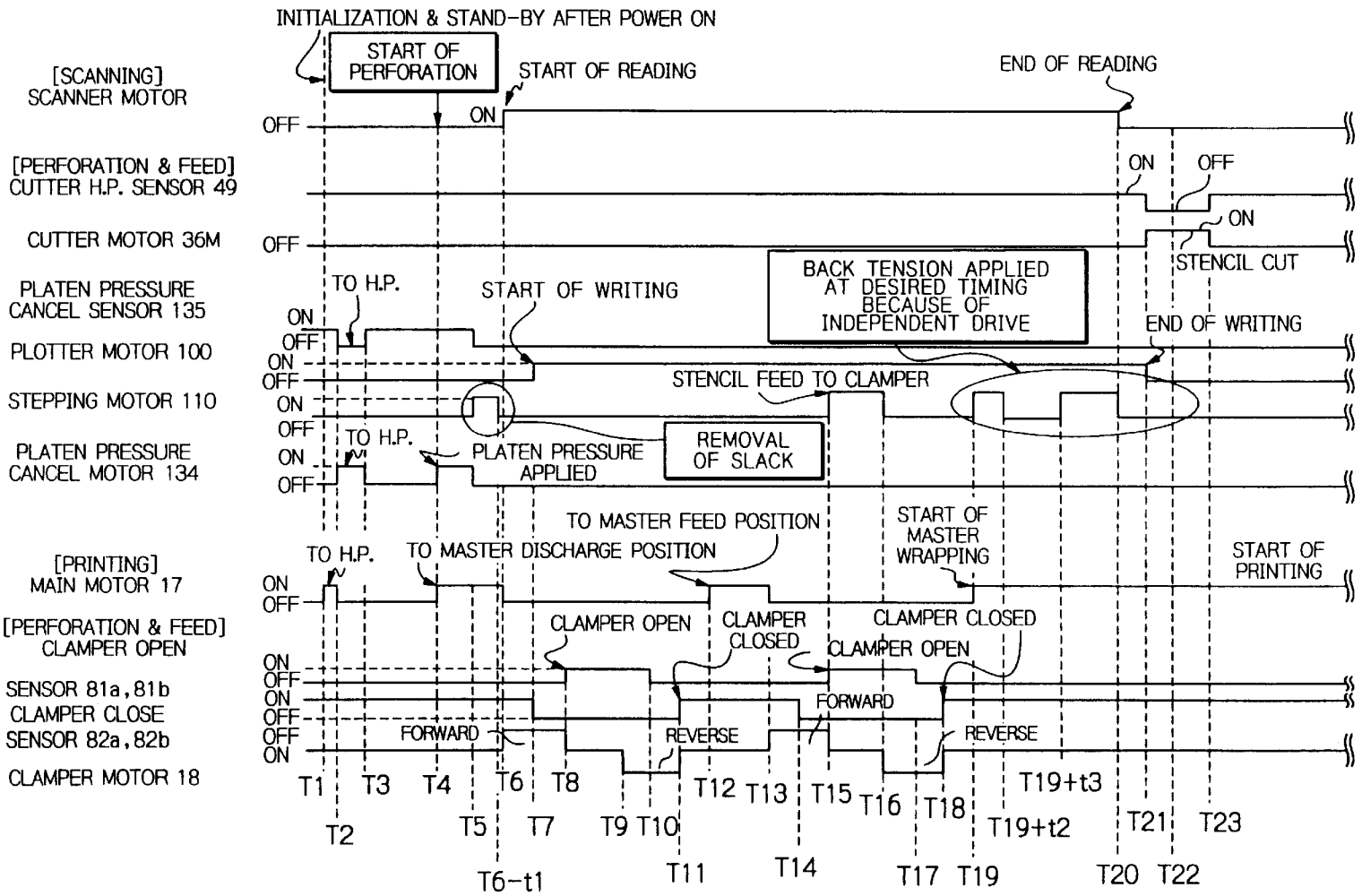

FIG. 8 demonstrates a third specific procedure available with the illustrative embodiment. The third specific procedure is identical with the second specific procedure except that it further varies the excitation ON/OFF timing of the stepping motor 110 in accordance with the kind of the stencil 22 and/or the ambient conditions. Specifically, in the third procedure, at the same as the main motor 17 is turned on to start wrapping the stencil 22 around the print drum 2 at time T19, the stepping motor 110 is excited for a preselected period of time up to time T19+t2. Subsequently, the stepping motor 110 is again excited at time T19+t3 preceding the time T19+t4, and continuously excited up to time T20. With such an excitation pattern, the third procedure achieves the same advantages as the first and second procedures without regard to the kind of the master 22 or the ambient conditions.

Figure 9:
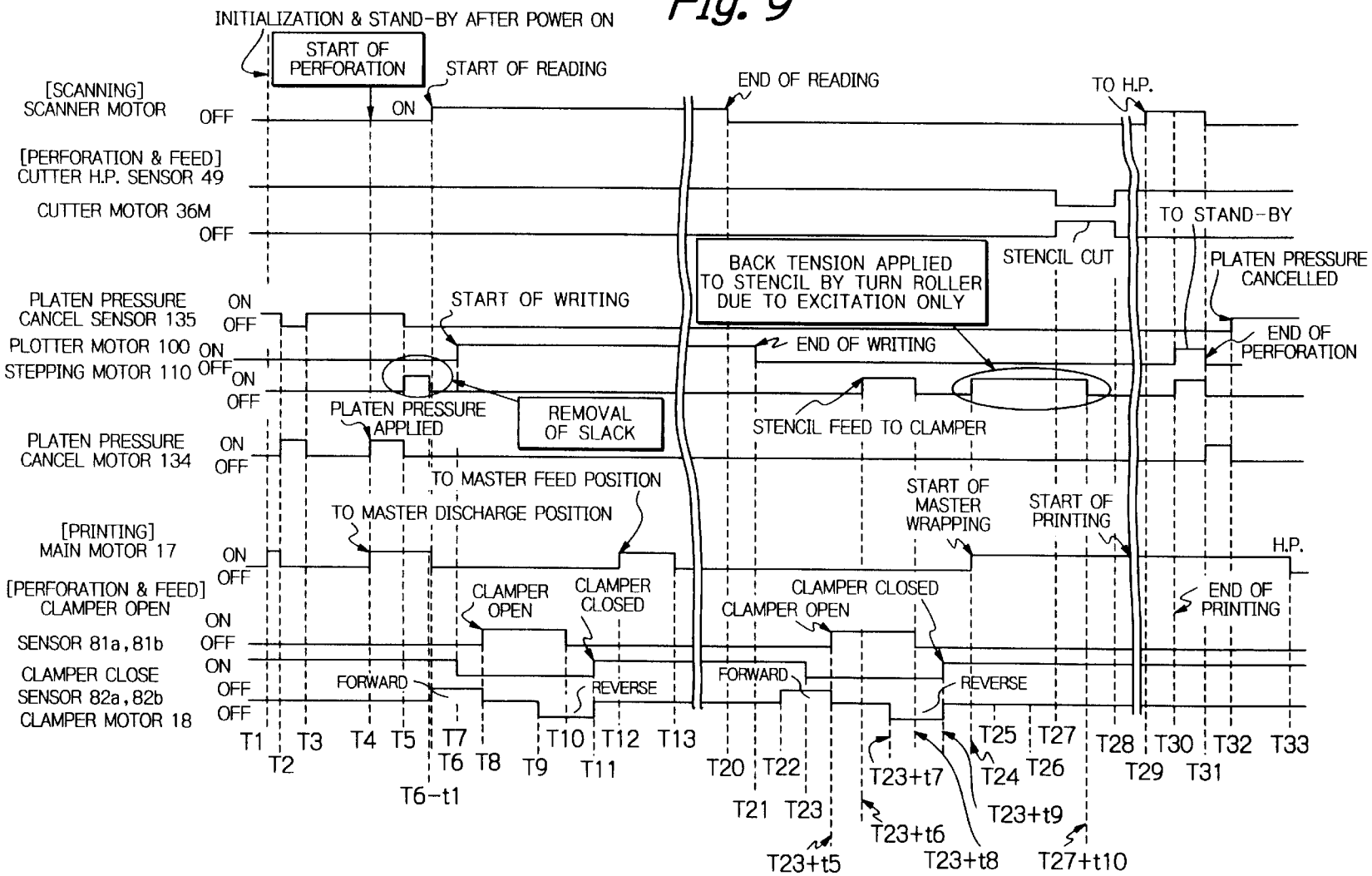

Referring to FIG. 9, a fourth specific procedure of the illustrative embodiment will be described. The fourth specific procedure is similar to the first specific procedure and is a solution to the problems of the second conventional procedure shown in FIG. 22. The following description will concentrate on differences between the first and fourth specific procedures.

In the first procedure, when the leading edge of the stencil 22 is introduced into the opened damper 4, the stepping motor 110 is turned at time T15 and then turned off at time T16 while the master making operation of the first conveying section 21-1 is under way. In the fourth procedure, the stepping motor 110 is turned on at time T23+t6 and then turned off at time T23+t8 after the end of the master making operation of the first conveying section 21-1, i.e., after time T21. When the energy saving mode is not desired or not necessary, the fourth procedure drives the stepping motor 10 at the same timing as the second procedure. Also, the fourth procedure excites the stepping motor 110 at the same timing as the second procedure when some shift of the stencil 22 from the perforation start position is acceptable.

The fourth procedure, like the second conventional procedure, accommodates the entire perforated part of the stencil 22 corresponding to a single master in the box 32, and then introduces the leading edge of the master 22 into the opened damper 4. Therefore, in the third procedure, the operation of each drive portion joining in this operation is shifted in the direction in which time T extends.

Differences between the fourth procedure and the first procedure and second conventional procedure will be described more specifically. In the first procedure of the illustrative embodiment, at time T16 when the leading edge of the stencil 22 has reached the damper 4 on the bases of the number of steps of the stepping motor 110, the motor 110 is turned off to stop the rotation of the turn roller pair 38. At the same time, the damper motor 18 is turned on at time T16 and driven in the reverse direction up to time T18 in order to close the damper 4. By contrast, the fourth procedure turns on the stepping motor 110 at time T23+t7 and then turns it off at time T23+t9.

The first procedure of the illustrative embodiment turns on the main motor 17 at time T19 for wrapping the stencil 22 around print drum 2 and excites the stepping motor 110 at same time (from time T19 to time T23). The fourth procedure turns on the main motor 17 at time T24 for wrapping the stencil 22 and continuously excites the stepping motor 110 from time T24 to time T27+t10. Further, the fourth procedure shifts the steps to be executed in the stand-by condition before the start of printing and after the end of printing, as shown in FIG. 9. Specifically, the fourth procedure turns off the main motor 17 and thereby stops the print drum 2 at the home position at time T33 later than the time T28.

In the first procedure, at time T25 (FIG. 5), at the same time as the guide/conveyor plate 33 is moved from the bending position to the guiding position, the plotter motor 100 is turned on to rotate the platen roller 27 and tension roller pair 37. Also, the stepping motor 110 is turned on to rotate the turn roller pair 38. The tension roller pair 37 and turn roller pair 38 convey the leading edge of the next perforated part of the stencil 22 cut by the cutter 36 to the downstream side of the path MR. At time T26 when the leading edge of the above stencil 22 is determined to have reached the stand-by position assigned to perforation shown in FIGS. 1 and 2, the plotter motor 100 and stepping motor 110 both are turned off. In the fourth procedure, such a sequence of steps are executed from time T30 to time T31. In this sense, the time when the stepping motor 110 is driven includes the time when the leading edge of the stencil 22 is fed to the print drum 22, the time when the leading edge of the stencil 22 cut by the cutter 36 is conveyed, and the time when the stencil 22 is set.

It should be noted that the platen pressure canceling mechanism or moving means 128 and master stocking means 31 are not essential with the present invention and may be omitted. The thermal head 26 playing the role of master making means may be replaced with flash type or laser type master making means.

The stencil printer 1 shown and described is only illustrative and may be replaced with a printer of the type feeding ink from the outside of a print drum, as taught in Laid-Open Publication No. 7-17013 or a printer whose master making section is bodily removable, as taught in Laid-Open Publication No. 10-202996.

In summary, it will be seen that the present invention provides a master making and feeding device for a printer having various unprecedented advantages, as enumerated below.

(1) When a first conveying section is perforating a stencil or after it has perforated a stencil, conveyance drive means drives a second conveying section at a preselected timing in order to feed the leading edge of the stencil to a print drum. At this instant, the conveyance drive means drives the second conveying section such that it conveys the stencil at a higher speed than the first conveying section. The device can therefore reduce a period of time necessary for the leading edge of the perforated stencil to be fed to the print drum and therefore FPT.

(2) The first and second conveying sections include a first drive source and a second drive source, respectively. The second drive source is implemented by a motor driven by pulses. The stencil conveying speed of the first conveying section and that of the second conveying section both are variable. Therefore, even when the second drive source or pulse-driven motor is driven, it does not vary the load of the first drive source and allows the stencil to be thermally perforated at a constant pitch. By varying the stencil conveying speeds of the first and second conveying sections, it is possible to prevent the stencil from slackening or creasing during conveyance. This advantages is achievable in addition to the above advantage (1).

(3) During or after the contact of master making means with a platen roller as effected by moving means, but just before a master making or perforating operation, the second conveying section is driven for a preselected period of time. This is successful to remove the slack of the stencil on a stencil conveyance path without driving the first conveying section and to prevent a perforation start position from being shifted. This advantage is achievable in addition to the above advantage (2).

(4) After the second conveying section has been driven for the preselected period of time, the pulse-driven motor is excited up to the next drive of the second conveying section. Therefore, the stencil located at the perforation start position can be surely held there without regard to, e.g., vibration. This advantage is achievable in addition to the above advantage (3).

(5) In a stand-by state assigned to perforation, in which the master making means is released from the platen roller by the moving means, the excitation of the pulse-driven motor is interrupted or current to be fed thereto is reduced up to the next drive of the second conveying section. It is therefore not necessary to hold the stencil at the perforation start position in the stand-by state. The device therefore saves energy consumption. This advantage is achievable in addition to the above advantage (4).

(6) Mode selecting means allows the operator to determine whether or not to interrupt the excitation of the pulse-driven motor or reduce current to be fed thereto. Therefore, when, e.g., strict control over the image position of a master is not necessary, the operator can determine on mode selecting means whether or not to save energy by canceling the excitation of the motor or reducing current supply thereto. This advantage is achievable in addition to the above advantage (5).

(7) The mode selecting means is arranged on an operation panel and therefore easy to operate.

(8) When the perforated stencil is wrapped around the print drum, the excitation ON/OFF timing of the pulse-driven motor is variable. For example, the excitation ON/OFF timing is variable in accordance with the degree of creasing that differs from one kind of stencil to another kind of stencil or ambient conditions including temperature and humidity. It follows that the stencil can be wrapped around the print drum without any crease. This advantage is achievable in addition to the above advantages (1) through (7).

(9) The pulse-driven motor is implemented by a stepping motor that easily implements accurate control over the position and speed of the stencil being conveyed. Also, it is easy to hold the stepping motor by excitation or to adjust the holding degree of the motor by reducing the current for excitation. In addition, the device is easily connectable to a microcomputer or similar control means. This advantage is achievable in addition to the above advantages (1) through (8).

Various modifications will become possible for those skilled in the art after receiving the teachings of the present disclosure without departing from the scope thereof.

What is claimed is:

1. A master making and feeding device for a printer, comprising:

first conveying means including a rotatable platen roller for pressing a stencil between master making means and said platen roller to thereby thermally perforate said stencil, and conveying said perforated stencil to a downstream side in a direction of stencil conveyance;

second conveying means arranged between said first conveying means and a print drum, around which the perforated stencil is to be wrapped around, for conveying said perforated stencil conveyed by said first conveying means toward said print drum; and conveyance drive means for driving, at a preselected timing during or after a perforation of the stencil effected by said first conveying means, said second conveying means to thereby feed a leading edge of the perforated stencil to the print drum, and driving second conveying means such that said second conveying means conveys said perforated stencil at a higher speed than said first conveying means, wherein said first conveying means comprises a first drive source while said second conveying means comprises a second drive source implemented by a pulse-drive motor, and wherein a stencil conveying speed of said first conveying means and a stencil conveying speed of said second conveying means both are variable, and wherein said master making means is movable into and out of contact with said platen roller, wherein said first conveying means further comprises moving means for moving said master making means into and out of contact with said platen roller, and wherein said second conveying means is driven for the preselected period of time during or after a contact of said master making means with said platen roller, but just before a perforation of the stencil.

2. A device as claimed in claim 1, wherein after said second conveying means has been driven for the preselected period of time, said pulse-driven motor is excited up to a next drive of said second conveying means.

3. A device as claimed in claim 2, wherein in a stand-by state before perforation, in which said master making means is released from said platen roller by said moving means, an excitation of said pulse-driven motor is interrupted or a current to be fed to said pulse-driven motor is reduced up to the next drive of said second conveying means.

4. A device as claimed in claim 3, further comprising mode selecting means for allowing an operator of the printer to determine whether or not to select an operation for interrupting the excitation or reducing the current.

5. A device as claimed in claim 4, wherein said mode selecting means is positioned on an operation panel.

6. A device as claimed in claim 1, wherein when the perforated stencil is wrapped around the print drum, an excitation ON/OFF timing of said pulse-driven motor is variable.

7. A device as claimed in claim 1, wherein said pulse-driven motor comprises a stepping motor.

8. A master making and feeding device for a printer, comprising:

a first conveying section including a rotatable platen roller for pressing a stencil between a master making device and said platen roller to thereby thermally perforate said stencil, and conveying said perforated stencil to a downstream side in a direction of stencil conveyance;

a second conveying section arranged between said first conveying section and a print drum, around which the perforated stencil is to be wrapped around, for conveying said perforated stencil conveyed by said first conveying section toward said print drum; and a conveyance drive section for driving, at a preselected timing during or after perforation of the stencil effected by said first conveying section, said second conveying section to thereby feed a leading edge of the perforated stencil to the print drum, and driving said second conveying section such that said second conveying section conveys said perforated stencil at a higher speed than said first conveying section, wherein said first conveying section comprises a first drive source while said second conveying section comprises a second drive source implemented by a pulse-drive motor, and wherein a stencil conveying speed of said first conveying section and a stencil conveying speed of said second conveying section both are variable, and wherein said master making device is movable into and out of contact with said platen roller, wherein said first conveying section further comprises a moving device for moving said master making device into and out of contact with said platen roller, and wherein said second conveying section is driven for the preselected period of time during or after contact of said master making device with said platen roller, but just before perforation of the stencil.

9. A device as claimed in claim 8, wherein after said second conveying section has been driven for the preselected period of time, said pulse-driven motor is excited up to a next drive of said second conveying section.

10. A device as claimed in claim 9, wherein in a stand-by state before perforation, in which said master making device is released from said platen roller by said moving device, an excitation of said pulse-driven motor is interrupted or a current to be fed to said pulse-driven motor is reduced up to the next drive of said second conveying section.

11. A device as claimed in claim 10, further comprising a mode selecting device for allowing an operator to determine whether or not to select an operation for interrupting the excitation or reducing the current.

12. A device as claimed in claim 11, wherein said mode selecting device is positioned on an operation panel.

13. A device as claimed in claim 8, wherein when the perforated stencil is wrapped around the print drum, an excitation ON/OFF timing of said pulse-driven motor is variable.

14. A device as claimed in claim 8, wherein said pulse-driven motor comprises a stepping motor.

15. A master making and feeding device for a printer, comprising:

first conveying means including a rotatable platen roller for pressing a stencil between master making means and said platen roller to thereby thermally perforate said stencil, and conveying said perforated stencil to a downstream side in a direction of stencil conveyance;

second conveying means arranged between said first conveying means and a print drum, around which the perforated stencil is to be wrapped around, for conveying said perforated stencil conveyed by said first conveying means toward said print drum; and conveyance drive means for driving, at a preselected timing during or after a perforation of the stencil effected by said first conveying means, said second conveying means to thereby feed a leading edge of the perforated stencil to the print drum, and driving second conveying means such that said second conveying means conveys said perforated stencil at a higher speed than said first conveying means, wherein said master making means is movable into and out of contact with said platen roller, wherein said first conveying means further comprises moving means for moving said master making means into and out of contact with said platen roller, and wherein said second conveying means is driven for the preselected period of time during or after a contact of said master making means with said platen roller, but just before a perforation of the stencil.

16. A master making and feeding device for a printer, comprising:

a first conveying section including a rotatable platen roller for pressing a stencil between a master making device and said platen roller to thereby thermally perforate said stencil, and conveying said perforated stencil to a downstream side in a direction of stencil conveyance;

a second conveying section arranged between said first conveying section and a print drum, around which the perforated stencil is to be wrapped around, for conveying said perforated stencil conveyed by said first conveying section toward said print drum; and a conveyance drive section for driving, at a preselected timing during or after perforation of the stencil effected by said first conveying section, said second conveying section to thereby feed a leading edge of the perforated stencil to the print drum, and driving said second conveying section such that said second conveying section conveys said perforated stencil at a higher speed than said first conveying section, wherein said master making device is movable into and out of contact with said platen roller, wherein said first conveying section further comprises a moving device for moving said master making device into and out of contact with said platen roller, and wherein said second conveying section is driven for a preselected period of time during or after contact of said master making device with said platen roller, but just before perforation of the stencil.

* * * * *

UNITED STATES PATENT AND TRADEMARK OFFICE

CERTIFICATE OF CORRECTION

PATENT NO. : 6,571,698 B1
DATED : June 3, 2003
INVENTOR(S) : Hideyuki Kagawa

It is certified that error appears in the above-identified patent and that said Letters Patent is hereby corrected as shown below:

Column 1,
Line 64, delete “capable of”;

Column 3,
Lines 63 and 66, change “damper” to -- clamper --;

Column 5,
Line 8 and 9 (both occurrences), change “damper” to -- clamper --;

Column 6,
Line 12, change “cancel led” to -- cancelled --;

Column 7,
Line 5, change “380” to -- 38C --;
Line 60, change “damper” to -- clamper --;

Column 8,
Lines 14, 45, 48, 52, 55 and 61, change “damper” to -- clamper --;
Line 46, change “lading” to -- leading --;

Column 9,
Lines 5, 6, 7, 9, 15, 16, 20, 31 (both occurrences), 32, 37, 45, 48 and 55, change “damper” to -- clamper --;

Column 10,
Lines 19, 22, 23, 26, 28, 30 and 31, change “damper” to -- clamper --;

Column 11,
Lines 23 and 35, change “damper” to -- clamper --;

Column 12,
Line 1, change “damper” to -- clamper --;

Column 13,
Line 13, change “damper” to -- clamper --;
Line 42, change “ant” to -- and --;

Column 14,
Lines 27, 29, 31, 33, 34, 48, 49, 51, 52, 54, 56 and 59, change “damper” to -- clamper --;

UNITED STATES PATENT AND TRADEMARK OFFICE

CERTIFICATE OF CORRECTION

PATENT NO. : 6,571,698 B1
DATED : June 3, 2003
INVENTOR(S) : Hideyuki Kagawa

It is certified that error appears in the above-identified patent and that said Letters Patent is hereby corrected as shown below:

Column 15,
Line 8, change “cancel led” to -- cancelled --;
Line 22, change “damper” to -- clamper --;

Column 16,
Lines 32, 33, 34, 37, 38, 40, 41, 49, 51, 54, 57, 58, 60, 62 and 64 (both occurrences), change “damper” to -- clamper --;

Column 17,
Lines 1, 55 and 62, change “damper” to -- clamper --;

Column 18,
Lines 27 and 45, change “damper” to -- clamper --;

Column 19,
Lines 58, 63, 65 and 66, change “damper” to -- clamper --;

Column 20,
Lines 2, 5, 6, 8, 11, 14, 15, 17 and 19, change “damper” to -- clamper --;
Line 7, change “sate” to -- state --;
Line 52, change “380” to -- 38C --;

Column 21,
Line 48, change “damper” to -- clamper --;

Column 23,
Line 7, change “form” to -- from --;
Line 22, change “conveyance,” to -- conveyance --;

Column 25,
Lines 15 and 58, change “380” to -- 38C --;
Line 28, change “camper” to -- clamper --;
Line 41, change “v2>v1” to -- v2>v1 --;
Line 51, change “damper” to -- clamper --;

Column 26,
Line 14, change “camper” to -- clamper --;
Line 35, change “control led” to -- controlled --;
Lines 46 and 55, change “damper” to -- clamper --;

UNITED STATES PATENT AND TRADEMARK OFFICE

CERTIFICATE OF CORRECTION

PATENT NO. : 6,571,698 B1
DATED : June 3, 2003
INVENTOR(S) : Hideyuki Kagawa

It is certified that error appears in the above-identified patent and that said Letters Patent is hereby corrected as shown below:

Column 27,
Line 1, change “des ire” to -- desire --;

Column 28,
Lines 2, 19, 26, 29 and 31, change “damper” to -- clamper --.

Signed and Sealed this

Thirteenth Day of September, 2005

JON W. DUDAS
*Director of the United States Patent and Trademark Office*